United States Patent [19]

Takashima et al.

[11] Patent Number: 4,541,111

[45] Date of Patent: Sep. 10, 1985

[54] LSP VOICE SYNTHESIZER

[75] Inventors: Susumu Takashima; Takao Kanke; Naoki Inagaki; Kazumasa Fukushima, all of Tokyo, Japan

[73] Assignee: Casio Computer Co. Ltd., Tokyo, Japan

[21] Appl. No.: 396,140

[22] Filed: Jul. 7, 1982

[30] Foreign Application Priority Data

Jul. 16, 1981 [JP] Japan ..... 56-111428

[51] Int. Cl.[3] ..... G10L 1/00

[52] U.S. Cl. ..... 381/51

[58] Field of Search ..... 381/41-53; 364/513, 513.5, 724

[56] References Cited

U.S. PATENT DOCUMENTS 4,209,844 6/1980 Brantingham et al. ..... 381/51

4,393,272 7/1983 Itakura et al. ..... 381/51

FOREIGN PATENT DOCUMENTS 2826570 1/1979 Fed. Rep. of Germany .

*Primary Examiner*—E. S. Matt Kemeny

*Attorney, Agent, or Firm*—Frishauf, Holtz, Goodman & Woodward

[57] ABSTRACT

An LSP synthesizer (Line Spectrum Pair) includes an LSP voice synthesizer digital filter arranged for parallel operation upon voice parameters and excitation information, to obtain an LSP synthesized sound. The LSP voice synthesizer digital filter includes at least a parallel multiplier and a parallel adder. The parallel multiplier divides data into a set of upper bits and a set of lower bits and multiplies the upper and lower bits separately at specified different timings. The multiplication results are supplied to a delay circuit which adjusts timings of the multiplication results. These multiplication results are synthesized by the parallel adder to obtain a single piece of data.

5 Claims, 46 Drawing Figures

FIG. 3 (PRIOR ART)

(A)

$$e_1(n)=\frac{1}{2}o_{10}(n-1) \qquad e_2(n)=\frac{1}{2}o_{10}(n-1)$$

$$e_3(n)=e_1(n)+e'_1(n-1) \qquad e_4(n)=e_2(n)+e'_2(n-1)$$

$$e_5(n)=e_3(n)+e'_3(n-1) \qquad e_6(n)=e_4(n)+e'_4(n-1)$$

$$e_7(n)=e_5(n)+e'_5(n-1) \qquad e_8(n)=e_6(n)+e'_6(n-1)$$

$$e_9(n)=e_7(n)+e'_7(n-1) \qquad e_{10}(n)=e_8(n)+e'_8(n-1)$$

(B)

$$e'_1(n)=e_1(n-1)+c_1e_1(n) \qquad e'_2(n)=e_2(n-1)+c_2e_2(n)$$

$$e'_3(n)=e_3(n-1)+c_3e_3(n) \qquad e'_4(n)=e_4(n-1)+c_4e_4(n)$$

$$e'_5(n)=e_5(n-1)+c_5e_5(n) \qquad e'_6(n)=e_6(n-1)+c_6e_6(n)$$

$$e'_7(n)=e_7(n-1)+c_7e_7(n) \qquad e'_8(n)=e_8(n-1)+c_8e_8(n)$$

(C)

$$o_1(n)=u(n)-e'_1(n) \qquad o_2(n)=o_1(n)-e'_2(n)$$

$$o_3(n)=o_2(n)-e'_3(n) \qquad o_4(n)=o_3(n)-e'_4(n)$$

$$o_5(n)=o_4(n)-e'_5(n) \qquad o_6(n)=o_5(n)-e'_6(n)$$

$$o_7(n)=o_6(n)-e_9(n) \qquad o_8(n)=o_7(n)-e'_7(n)$$

$$o_9(n)=o_8(n)-e_{10}(n) \qquad o_{10}(n)=o_9(n)-e'_8(n)$$

FIG. 5

(A)

| | |
|---|---|
| SYNC. | SOUNDLESS INTERVAL |

(B)

| | | |
|---|---|---|
| SYNC. | AMPLITUDE | |
| SYNC. | PITCH | |
| $W_1$ | | $W_2$ |
| $W_3$ | | $W_4$ |
| $W_5$ | | $W_6$ |
| $W_7$ | | $W_8$ |

(C)

| | | |
|---|---|---|
| SYNC. | AMPLITUDE | |
| SYNC. | PITCH | $W_1$ |
| $W_2$ | | $W_3$ |
| $W_4$ | | $W_5$ |
| $W_6$ | | $W_7$ |
| $W_8$ | | |

(D)

| | | |
|---|---|---|
| SYNC. | AMPLITUDE | |
| SYNC. | PITCH | $W_1$ |
| $W_2$ | | $W_3$ |
| $W_4$ | | $W_5$ |
| $W_6$ | | $W_7$ |
| $W_8$ | | |

FIG. 7A

| | $T_1$ | $T_2$ | $T_3$ | $T_4$ | $T_5$ | $T_6$ | $T_7$ | $T_8$ | $T_9$ | $T_{10}$ | $T_{11}$ |
|---|---|---|---|---|---|---|---|---|---|---|---|
| $\phi_A$ | | ○ | | ○ | | ○ | | ○ | | ○ | |
| $\phi_B$ | ○ | | ○ | | ○ | | ○ | | ○ | | ○ |
| $\phi_C$ | | ○ | | ○ | | ○ | | ○ | | ○ | |
| $\phi_D$ | | | ○ | | ○ | | ○ | | ○ | | ○ |
| $\phi_E$ | | | ○ | | ○ | | ○ | | ○ | | ○ |
| $\phi_F$ | ○ | | ○ | | ○ | | ○ | | ○ | | ○ |
| $\phi_G$ | | | | ○ | | ○ | | ○ | | ○ | |
| $\phi_H$ | | ○ | | ○ | | ○ | | ○ | | ○ | |
| $\phi_I$ | ○ | | ○ | | ○ | | ○ | | ○ | | ○ |
| $\phi_J$ | ○ | | ○ | | ○ | | ○ | | ○ | | ○ |
| $\phi_K$ | | | | | | ○ | | ○ | | ○ | |
| $\phi_L$ | ○ | ○ | ○ | ○ | ○ | ○ | ○ | ○ | ○ | ○ | ○ |
| $\phi_M$ | | | | ○ | | | | | | | |
| $\phi_N$ | | | | | | | | | | | |
| $\phi_O$ | | | | | ○ | | | | | | |
| $\phi_P$ | | | | | | | | | | | |
| $\phi_Q$ | | | | | | | | | | | |
| $\phi_R$ | ○ | | ○ | | ○ | | ○ | | ○ | | ○ |

FIG. 7B

| $T_{12}$ | $T_{13}$ | $T_{14}$ | $T_{15}$ | $T_{16}$ | $T_{17}$ | $T_{18}$ | $T_{19}$ | $T_{20}$ | $T_{21}$ | $T_{22}$ | $T_{23}$ |
|---|---|---|---|---|---|---|---|---|---|---|---|
| ○ | | ○ | | ○ | | ○ | | ○ | ○ | | |
| | ○ | | ○ | | ○ | | ○ | | | | |
| ○ | | ○ | | ○ | | ○ | | ○ | | | |
| | ○ | | ○ | | ○ | | ○ | | ○ | | |
| | ○ | | ○ | | ○ | | ○ | | | | |
| | ○ | | ○ | | ○ | | ○ | | | | |
| ○ | | ○ | | ○ | | ○ | | ○ | ○ | ○ | |
| ○ | | ○ | | ○ | | ○ | | ○ | | | |
| | ○ | | ○ | | | | | | | | |
| | ○ | | ○ | | ○ | | ○ | | | ○ | |
| ○ | | ○ | | ○ | | | | | | | |
| ○ | ○ | ○ | ○ | ○ | | | | | | | |
| | | | | | | | | | | | |
| | | | | | ○ | ○ | ○ | ○ | ○ | ○ | |
| | | | | | | | | | | | |
| | | | | | | | | | | ○ | ○ |
| | | | | | | | | ○ | | | |
| | ○ | | ○ | | ○ | | ○ | | | ○ | |

FIG. 8A

| TIME | MULTIPLIER | | | ADDITION CIRCUIT | | |
|---|---|---|---|---|---|---|
| | A INPUT | B INPUT | OUTPUT | A INPUT | B INPUT | OUTPUT |
| $T_1$ | $C_{1U}$ | $e_{1(n)}$ | $A_U\ V_{(n)}$ | * | * | * |
| $T_2$ | $C_{1L}$ | $e_{1(n)}$ | $A_L\ V_{(n)}$ | $A_L\ V_{(n)}$ | $A_U\ V_{(n)}$ | * |
| $T_3$ | $C_{2U}$ | $e_{2(n)}$ | $C_{1U}\ e_{1(n)}$ | 0 | $U_{(n)}$ | $U_{(n)}$ |
| $T_4$ | $C_{2L}$ | $e_{2(n)}$ | $C_{1L}\ e_{1(n)}$ | $C_{1L}\ e_{1(n)}$ | $C_{1U}\ e_{1(n)}$ | $U_{(n)}$ |
| $T_5$ | $C_{3U}$ | $e_{3(n)}$ | $C_{2U}\ e_{2(n)}$ | $e_{1(n-1)}$ | $C_1\ e_{1(n)}$ | $C_1\ e_{1(n)}$ |
| $T_6$ | $C_{3L}$ | $e_{3(n)}$ | $C_{2L}\ e_{2(n)}$ | $C_{2L}\ e_{2(n)}$ | $C_{2U}\ e_{2(n)}$ | $e'_{1(n)}$ |
| $T_7$ | $C_{4U}$ | $e_{4(n)}$ | $C_{3U}\ e_{3(n)}$ | $e_{2(n-1)}$ | $C_2\ e_{2(n)}$ | $C_2\ e_{2(n)}$ |
| $T_8$ | $C_{4L}$ | $e_{4(n)}$ | $C_{3L}\ e_{3(n)}$ | $C_{3L}\ e_{3(n)}$ | $C_{3U}\ e_{3(n)}$ | $e'_{2(n)}$ |
| $T_9$ | $C_{5U}$ | $e_{5(n)}$ | $C_{4U}\ e_{4(n)}$ | $e_{3(n-1)}$ | $C_3\ e_{3(n)}$ | $C_3\ e_{3(n)}$ |
| $T_{10}$ | $C_{5L}$ | $e_{5(n)}$ | $C_{4L}\ e_{4(n)}$ | $C_{4L}\ e_{4(n)}$ | $C_{4U}\ e_{4(n)}$ | $e'_{3(n)}$ |
| $T_{11}$ | $C_{6U}$ | $e_{6(n)}$ | $C_{5U}\ e_{5(n)}$ | $e_{4(n-1)}$ | $C_4\ e_{4(n)}$ | $C_4\ e_{4(n)}$ |
| $T_{12}$ | $C_{6L}$ | $e_{6(n)}$ | $C_{5L}\ e_{5(n)}$ | $C_{5L}\ e_{5(n)}$ | $C_{5U}\ e_{5(n)}$ | $e'_{4(n)}$ |
| $T_{13}$ | $C_{7U}$ | $e_{7(n)}$ | $C_{6U}\ e_{6(n)}$ | $e_{5(n-1)}$ | $C_5\ e_{5(n)}$ | $C_5\ e_{5(n)}$ |
| $T_{14}$ | $C_{7L}$ | $e_{7(n)}$ | $C_{6L}\ e_{6(n)}$ | $C_{6L}\ e_{6(n)}$ | $C_{6U}\ e_{6(n)}$ | $e'_{5(n)}$ |
| $T_{15}$ | $C_{8U}$ | $e_{8(n)}$ | $C_{7U}\ e_{7(n)}$ | $e_{6(n-1)}$ | $C_6\ e_{6(n)}$ | $C_6\ e_{6(n)}$ |
| $T_{16}$ | $C_{8L}$ | $e_{8(n)}$ | $C_{7L}\ e_{7(n)}$ | $C_{7L}\ e_{7(n)}$ | $C_{7U}\ e_{7(n)}$ | $e'_{6(n)}$ |
| $T_{17}$ | 0 | * | $C_{8U}\ e_{8(n)}$ | $e_{7(n-1)}$ | $C_7\ e_{7(n)}$ | $C_7\ e_{7(n)}$ |
| $T_{18}$ | 0 | * | $C_{8L}\ e_{8(n)}$ | $C_{8L}\ e_{8(n)}$ | $C_{8U}\ e_{8(n)}$ | $e'_{7(n)}$ |
| $T_{19}$ | 0 | * | 0 | $e_{8(n-1)}$ | $C_8\ e_{8(n)}$ | $C_8\ e_{8(n)}$ |
| $T_{20}$ | 0 | * | 0 | 0 | 0 | $e'_{8(n)}$ |
| $T_{21}$ | 0 | * | 0 | 0 | 0 | 0 |
| $T_{22}$ | $A_U$ | $V_{(n+1)}$ | 0 | * | * | 0 |
| $T_{23}$ | $A_L$ | $V_{(n+1)}$ | 0 | * | * | * |
| $T_1$ | $C_{1U}$ | $e_{1(n+1)}$ | $A_U \cdot V_{(n+1)}$ | * | * | * |

FIG. 8B

| ADDITION/SUBTRACTION CIRCUIT | | | SHIFT REGISTERS 34 & 44 | | | OUTPUT |
|---|---|---|---|---|---|---|
| A INPUT | B INPUT | OUTPUT | INPUT | 8BIT S.R. OUTPUT | 13BIT S.R. OUTPUT | |
| $e_1(n)$ | $e'_1(n-1)$ | * | $e_1(n)$ | $e'_1(n-1)$ | $e_{10}(n-2)$ | $e_1(n-2)$ |
| * | * | $e_3(n)$ | △ * | $e'_1(n-1)$ | 0 | |
| $e_2(n)$ | $e'_2(n-1)$ | * | $e_2(n)$ | $e'_2(n-1)$ | 0 | |
| $U(n)$ | 0 | $e_4(n)$ | △ $U(n)$ | $e'_2(n-1)$ | $e_1(n-1)$ | |
| $e_3(n)$ | $e'_3(n-1)$ | $U(n)$ | $e_3(n)$ | $e'_3(n-1)$ | $e_1(n-1)$ | $e_1(n-1)$ |
| $-e'_1(n)$ | $U(n)$ | $e_5(n)$ | △$e'_1(n)$ | $e'_3(n-1)$ | $e_2(n-1)$ | |
| $e_4(n)$ | $e'_4(n-1)$ | $O_1(n)$ | $e_4(n)$ | $e'_4(n-1)$ | $e_2(n-1)$ | |
| $-e'_2(n)$ | $O_1(n)$ | $e_6(n)$ | △$e'_2(n)$ | $e'_4(n-1)$ | $e_3(n-1)$ | |
| $e_5(n)$ | $e'_5(n-1)$ | $O_2(n)$ | $e_5(n)$ | $e'_5(n-1)$ | $e_3(n-1)$ | |
| $-e'_3(n)$ | $O_2(n)$ | $e_7(n)$ | △ $e_3(n)$ | $e'_5(n-1)$ | $e_4(n-1)$ | |
| $e'_6(n)$ | $e'_6(n-1)$ | $O_3(n)$ | $e_6(n)$ | $e'_6(n-1)$ | $e_4(n-1)$ | |
| $-e'_4(n)$ | $O_3(n)$ | $e_8(n)$ | △ $e'_4(n)$ | $e'_6(n-1)$ | $e_5(n-1)$ | |
| $e_7(n)$ | $e'_7(n-1)$ | $O_4(n)$ | $e_7(n)$ | $e'_7(n-1)$ | $e_5(n-1)$ | |
| $-e'_5(n)$ | $O_4(n)$ | $e_9(n)$ | △$e'_5(n)$ | $e'_7(n-1)$ | $e_6(n-1)$ | |
| $e_8(n)$ | $e'_8(n-1)$ | $O_5(n)$ | $e_8(n)$ | $e'_8(n-1)$ | $e_6(n-1)$ | |
| $-e'_6(n)$ | $O_5(n)$ | $e_{10}(n)$ | △$e'_6(n)$ | $e'_8(n-1)$ | $e_7(n-1)$ | |
| $e_9(n)$ | $O_6(n)$ | $O_6(n)$ | $e_9(n)$ | * | $e_7(n-1)$ | |
| $-e'_7(n)$ | $C_7(n)$ | $O_7(n)$ | △$e'_7(n)$ | * | $e_8(n-1)$ | |
| $e_{10}(n)$ | $O_8(n)$ | $O_8(n)$ | $e_{10}(n)$ | $U(n)$ | $e_8(n-1)$ | |
| $-e'_8(n)$ | $O_9(n)$ | $O_9(n)$ | △$e'_8(n)$ | $U(n)$ | $e_9(n-1)$ | |
| 0 | $e_1(n+1)$ | $O_{10}(n)$ | | $e'_1(n)$ | $e_9(n-1)$ | |
| 0 | $e_1(n+1)$ | $e_1(n+1)$ | 0 | $e'_1(n)$ | $e_9(n-1)$ | |
| * | * | $e_1(n+1)$ | | $e'_1(n)$ | $e_{10}(n-1)$ | |
| $e_1(n+1)$ | $e_1(n)$ | * | $e_1(n+1)$ | $e'_1(n)$ | $e_{10}(n-1)$ | |

| | $T_1$ | $T_2$ | $T_3$ | $T_4$ | $T_5$ | $T_6$ | $T_7$ | $T_8$ | $T_9$ | $T_{10}$ | $T_{11}$ |
|---|---|---|---|---|---|---|---|---|---|---|---|
| $\phi_p$ | | | | | | | | | | | |
| $\phi_q$ | | O | | O | | O | | O | | O | |
| $\phi_r$ | O | | O | | O | | O | | O | | O |
| $\phi_i$ | O | | O | | O | | O | | O | | O |

FIG. 16A

| | $T_{12}$ | $T_{13}$ | $T_{14}$ | $T_{15}$ | $T_{16}$ | $T_{17}$ | $T_{18}$ | $T_{19}$ | $T_{20}$ | $T_{21}$ | $T_{22}$ | $T_{23}$ |
|---|---|---|---|---|---|---|---|---|---|---|---|---|
| $\phi_p$ | | | | | | | | | | | O | |
| $\phi_q$ | O | | O | | O | | | | | | | O |
| $\phi_r$ | | O | | O | | O | | | | | | |
| $\phi_i$ | | O | | O | | | | | | | | |

FIG. 16B

FIG. 18A

| TIME | MULTIPLIER | | | ADDITION CIRCUIT | | |
|---|---|---|---|---|---|---|
| | A INPUT | B INPUT | OUTPUT | A INPUT | B INPUT | OUTPUT |
| $T_1$ | $C_{1L}$ | $e_1(n)$ | $A_L \cdot V(n)$ | * | * | * |
| $T_2$ | $C_{1U}$ | $e_1(n)$ | $A_U \cdot V(n)$ | $A_U \cdot V(n)$ | $A_L \cdot V(n)$ | * |
| $T_3$ | $C_{2L}$ | $e_2(n)$ | $C_{1L} \cdot e_1(n)$ | 0 | $U(n)$ | $U(n)=A \cdot V(n)$ |
| $T_4$ | $C_{2U}$ | $e_2(n)$ | $C_{1U} \cdot e_1(n)$ | $C_{1U} \cdot e_1(n)$ | $C_{1L} \cdot e_1(n)$ | $U(n)$ |
| $T_5$ | $C_{3L}$ | $e_3(n)$ | $C_{2L} \cdot e_2(n)$ | $e_1(n-1)$ | $C_1 \cdot e_1(n)$ | $C_1 \cdot e_1(n)$ |
| $T_6$ | $C_{3U}$ | $e_3(n)$ | $C_{2U} \cdot e_2(n)$ | $C_{2U} \cdot e_2(n)$ | $C_{2L} \cdot e_2(n)$ | $e'_1(n)$ |
| $T_7$ | $C_{4L}$ | $e_4(n)$ | $C_{3L} \cdot e_3(n)$ | $e_2(n-1)$ | $C_2 \cdot e_2(n)$ | $C_2 \cdot e_2(n)$ |
| $T_8$ | $C_{4U}$ | $e_4(n)$ | $C_{3U} \cdot e_3(n)$ | $C_{3U} \cdot e_3(n)$ | $C_{3L} \cdot e_3(n)$ | $e'_2(n)$ |
| $T_9$ | $C_{5L}$ | $e_5(n)$ | $C_{4L} \cdot e_4(n)$ | $e_3(n-1)$ | $C_3 \cdot e_3(n)$ | $C_3 \cdot e_3(n)$ |
| $T_{10}$ | $C_{5U}$ | $e_5(n)$ | $C_{4U} \cdot e_4(n)$ | $C_{4U} \cdot e_4(n)$ | $C_{4L} \cdot e_4(n)$ | $e'_3(n)$ |
| $T_{11}$ | $C_{6L}$ | $e_6(n)$ | $C_{5L} \cdot e_5(n)$ | $e_4(n-1)$ | $C_4 \cdot e_4(n)$ | $C_4 \cdot e_4(n)$ |
| $T_{12}$ | $C_{6U}$ | $e_6(n)$ | $C_{5U} \cdot e_5(n)$ | $C_{5U} \cdot e_5(n)$ | $C_{5L} \cdot e_5(n)$ | $e'_4(n)$ |
| $T_{13}$ | $C_{7L}$ | $e_7(n)$ | $C_{6L} \cdot e_6(n)$ | $e_5(n-1)$ | $C_5 \cdot e_5(n)$ | $C_5 \cdot e_5(n)$ |
| $T_{14}$ | $C_{7U}$ | $e_7(n)$ | $C_{6U} \cdot e_6(n)$ | $C_{6U} \cdot e_6(n)$ | $C_{6L} \cdot e_6(n)$ | $e_5(n)$ |
| $T_{15}$ | $C_{8L}$ | $e_8(n)$ | $C_{7L} \cdot e_7(n)$ | $e_6(n-1)$ | $C_6 \cdot e_6(n)$ | $C_6 \cdot e_6(n)$ |
| $T_{16}$ | $C_{8U}$ | $e_8(n)$ | $C_{7U} \cdot e_7(n)$ | $C_{7U} \cdot e_7(n)$ | $C_{7L} \cdot e_7(n)$ | $e_6(n)$ |
| $T_{17}$ | * | * | $C_{8L} \cdot e_8(n)$ | $e_7(n-1)$ | $C_7 \cdot e_7(n)$ | $C_7 \cdot e_7(n)$ |
| $T_{18}$ | * | * | $C_{8U} \cdot e_8(n)$ | $C_{8U} \cdot e_8(n)$ | $C_{8L} \cdot e_8(n)$ | $e_7(n)$ |
| $T_{19}$ | $A_L$ | $V(n+1)$ | * | $e_8(n-1)$ | $C_8 \cdot e_8(n)$ | $C_8 \cdot e_8(n)$ |
| $T_{20}$ | $A_U$ | $V(n+1)$ | * | * | * | $e_8(n)$ |
| $T_1$ | $C_{1L}$ | $e_1(n+1)$ | $A_L \cdot V(n+1)$ | * | * | * |

FIG. 18B

| ADDITION / SUBTRACTION CIRCUIT | | | SHIFT REGISTERS 34 & 110 | | | OUTPUT |
|---|---|---|---|---|---|---|
| A INPUT | B INPUT | OUTPUT | INPUT | 8BIT S.R. OUTPUT | 11BIT S.R. OUTPUT | |
| $e_1(n)$ | $e'_1(n-1)$ | $O_{18}(n-1)$ | $e_1(n)$ | $e'_1(n-1)$ | $e_8(n-2)$ | $O_{10}(n-1)$ |
| * | * | $e_3(n)$ | △ * | $e'_1(n-1)$ | $e_9(n-2)$ | |
| $e_2(n)$ | $e'_2(n-1)$ | * | $e_2(n)$ | $e'_2(n-1)$ | $e_9(n-2)$ | |
| $U(n)$ | 0 | $e_4(n)$ | △ $U(n)$ | $e'_2(n-1)$ | $e_1(n-1)$ | |
| $e_3(n)$ | $e'_3(n-1)$ | $U(n)$ | $e_3(n)$ | $e'_3(n-1)$ | $e_1(n-1)$ | |
| $-e'_1(n)$ | $U(n)$ | $e_5(n)$ | △ $e'_1(n)$ | $e'_3(n-1)$ | $e_2(n-1)$ | |
| $e_4(n)$ | $e'_4(n-1)$ | $O_1(n)$ | $e_4(n)$ | $e'_4(n-1)$ | $e_2(n-1)$ | |
| $-e'_2(n)$ | $O_1(n)$ | $e_6(n)$ | △ $e'_2(n)$ | $e'_4(n-1)$ | $e_3(n-1)$ | |
| $e_5(n)$ | $e'_5(n-1)$ | $O_2(n)$ | $e_5(n)$ | $e'_5(n-1)$ | $e_3(n-1)$ | |
| $-e'_3(n)$ | $O_2(n)$ | $e_7(n)$ | △ $e'_3(n)$ | $e'_5(n-1)$ | $e_4(n-1)$ | |
| $e_6(n)$ | $e'_6(n-1)$ | $O_3(n)$ | $e_6(n)$ | $e'_6(n-1)$ | $e_4(n-1)$ | |
| $-e'_4(n)$ | $O_3(n)$ | $e_8(n)$ | △ $e'_4(n)$ | $e'_6(n-1)$ | $e_5(n-1)$ | |
| $e_7(n)$ | $e'_7(n-1)$ | $O_4(n)$ | $e_7(n)$ | $e'_7(n-1)$ | $e_5(n-1)$ | |
| $-e'_5(n)$ | $O_4(n)$ | $e_9(n)$ | △ $e'_5(n)$ | $e'_7(n-1)$ | $e_6(n-1)$ | |
| $e_8(n)$ | $e'_8(n-1)$ | $O_5(n)$ | $e_8(n)$ | $e'_8(n-1)$ | $e_6(n-1)$ | |
| $-e'_6(n)$ | $O_5(n)$ | $e_{10}(n)$ | △ $e'_6(n)$ | $e'_8(n-1)$ | $e_7(n-1)$ | |
| $e_9(n)$ | $O_6(n)$ | $O_6(n)$ | $e_9(n)$ | * | $e_7(n-1)$ | |
| $e'_7(n)$ | $O_7(n)$ | $O_7(n)$ | △ $e'_7(n)$ | * | $e_8(n-1)$ | |
| $e_{10}(n)$ | $O_8(n)$ | $O_8(n)$ | | $U(n)$ | $e_8(n-1)$ | |
| $-e'_8(n)$ | $O_9(n)$ | $O_9(n)$ | △ $e'_8(n)$ | $U(n)$ | $e_8(n-1)$ | |
| $e_1(n+1)$ | $e'_1(n)$ | $O_{10}(n)$ | $e'_1(n+1)$ | $e'_1(n)$ | $e_8(n-1)$ | $O_{10}(n)$ |

FIG. 19A

| | $T_1$ | $T_2$ | $T_3$ | $T_4$ | $T_5$ | $T_6$ | $T_7$ | $T_8$ | $T_9$ | $T_{10}$ |
|---|---|---|---|---|---|---|---|---|---|---|
| $\phi_A$ | | | | | | | | | | |
| $\phi_B$ | ○ | ○ | ○ | ○ | ○ | ○ | ○ | ○ | ○ | ○ |
| $\phi_C$ | ○ | | ○ | | ○ | | ○ | | ○ | |
| $\phi_D$ | | ○ | | ○ | | ○ | | ○ | | ○ |
| $\phi_E$ | ○ | | ○ | | ○ | | ○ | | ○ | |
| $\phi_F$ | | ○ | | ○ | | ○ | | ○ | | ○ |
| $\phi_G$ | | | ○ | | | | | | | |
| $\phi_H$ | | | | | ○ | | ○ | | ○ | |
| $\phi_I$ | | ○ | | ○ | | ○ | | ○ | | ○ |
| $\phi_J$ | ○ | | ○ | | ○ | | ○ | | ○ | |
| $\phi_K$ | ○ | | ○ | | ○ | | ○ | | ○ | |
| $\phi_L$ | | | | ○ | | | | | | |
| $\phi_M$ | | | | | | ○ | | ○ | | ○ |
| $\phi_N$ | | | | | | | | | | |
| $\phi_P$ | ○ | ○ | ○ | ○ | | | | | | |
| $\phi_Q$ | | | | | ○ | ○ | ○ | ○ | ○ | ○ |
| $\phi_R$ | ○ | | ○ | | ○ | | ○ | | ○ | |
| $\phi_S$ | ○ | | | | | | | | | |

FIG. 19B

| $T_{11}$ | $T_{12}$ | $T_{13}$ | $T_{14}$ | $T_{15}$ | $T_{16}$ | $T_{17}$ | $T_{18}$ | $T_{19}$ | $T_{20}$ |
|---|---|---|---|---|---|---|---|---|---|
| | | | | | | | | ○ | ○ |
| ○ | ○ | ○ | ○ | ○ | ○ | | | | |
| ○ | | ○ | | ○ | | ○ | | ○ | |
| | ○ | | ○ | | ○ | | ○ | | ○ |
| ○ | | ○ | | ○ | | ○ | | ○ | |
| | ○ | | ○ | | ○ | | ○ | | ○ |
| | | | | | | | | | |
| ○ | | ○ | | ○ | | ○ | | ○ | |
| | ○ | | ○ | | ○ | | ○ | | ○ |
| ○ | | ○ | | ○ | | ○ | | ○ | |
| ○ | | ○ | | ○ | | | | | |
| | | | | | | | | | |
| | ○ | | ○ | | ○ | | | | |
| | | | | | | ○ | ○ | ○ | ○ |
| | | | | | | | | | |
| ○ | ○ | ○ | ○ | ○ | ○ | ○ | ○ | ○ | ○ |
| ○ | | ○ | | ○ | | ○ | | | |
| | | | | | | | | | |

FIG. 21A

| TIME | MULTIPLIER | | | ADDITION CIRCUIT | | |
|---|---|---|---|---|---|---|
| | A INPUT | B INPUT | OUTPUT | A INPUT | B INPUT | OUTPUT |
| $T_1$ | $C'_{1L}$ | $e_1(n)$ | * | * | * | $U(n-2)$ |
| $T_2$ | $C'_{1U}$ | $e_1(n)$ | * | * | * | * |
| $T_3$ | $C'_{2L}$ | $e_2(n)$ | $C'_{1L} \cdot e_1(n)$ | * | * | * |
| $T_4$ | $C'_{2U}$ | $e_2(n)$ | $C'_{1U} \cdot e_1(n)$ | $C'_{1U} \cdot e_1(n)$ | $C'_{1L} \cdot e_1(n)$ | * |
| $T_5$ | $C'_{3L}$ | $e_3(n)$ | $C'_{2L} \cdot e_2(n)$ | $C_1 \cdot e_1(n)$ | $e_1(n-1)$ | $C'_1 \cdot e_1(n)$ |
| $T_6$ | $C'_{3U}$ | $e_3(n)$ | $C'_{2U} \cdot e_2(n)$ | $C'_{2U} \cdot e_2(n)$ | $C'_{2L} \cdot e_2(n)$ | $e'_1(n)$ |
| $T_7$ | $C'_{4L}$ | $e_4(n)$ | $C'_{3L} \cdot e_3(n)$ | $C_2 \cdot e_2(n)$ | $e_2(n-1)$ | $C'_2 \cdot e_2(n)$ |
| $T_8$ | $C'_{4U}$ | $e_4(n)$ | $C'_{3U} \cdot e_3(n)$ | $C'_{3U} \cdot e_3(n)$ | $C'_{3L} \cdot e_3(n)$ | $e'_2(n)$ |
| $T_9$ | $C'_{5L}$ | $e_5(n)$ | $C'_{4L} \cdot e_4(n)$ | $C_3 \cdot e_3(n)$ | $e_3(n-1)$ | $C'_3 \cdot e_3(n)$ |
| $T_{10}$ | $C'_{5U}$ | $e_5(n)$ | $C'_{4U} \cdot e_4(n)$ | $C'_{4U} \cdot e_4(n)$ | $C'_{4L} \cdot e_4(n)$ | $e'_3(n)$ |
| $T_{11}$ | $C'_{6L}$ | $e_6(n)$ | $C'_{5L} \cdot e_5(n)$ | $C_4 \cdot e_4(n)$ | $e_4(n-1)$ | $C'_4 \cdot e_4(n)$ |
| $T_{12}$ | $C'_{6U}$ | $e_6(n)$ | $C'_{5U} \cdot e_5(n)$ | $C'_{5U} \cdot e_5(n)$ | $C'_{5L} \cdot e_5(n)$ | $e'_4(n)$ |
| $T_{13}$ | $C'_{7L}$ | $e_7(n)$ | $C'_{6L} \cdot e_6(n)$ | $C_5 \cdot e_5(n)$ | $e_5(n-1)$ | $C'_5 \cdot e_5(n)$ |
| $T_{14}$ | $C'_{7U}$ | $e_7(n)$ | $C'_{6U} \cdot e_6(n)$ | $C'_{6U} \cdot e_6(n)$ | $C'_{6L} \cdot e_6(n)$ | $e'_5(n)$ |
| $T_{15}$ | $C'_{8L}$ | $e_8(n)$ | $C'_{7L} \cdot e_7(n)$ | $C_6 \cdot e_6(n)$ | $e_6(n-1)$ | $C'_6 \cdot e_6(n)$ |
| $T_{16}$ | $C'_{8U}$ | $e_8(n)$ | $C'_{7U} \cdot e_7(n)$ | $C'_{7U} \cdot e_7(n)$ | $C'_{7L} \cdot e_7(n)$ | $e'_6(n)$ |
| $T_{17}$ | $A_L$ | $O_{10}(n-1)$ | $C'_{8L} \cdot e_8(n)$ | $C_7 \cdot e_7(n)$ | $e_7(n-1)$ | $C'_7 \cdot e_7(n)$ |
| $T_{18}$ | $A_U$ | $O_{10}(n-1)$ | $C'_{8U} \cdot e_8(n)$ | $C'_{8U} \cdot e_8(n)$ | $e'_{8L} \cdot e_8(n)$ | $e'_7(n)$ |
| $T_{19}$ | * | * | $A_L \cdot O_{10}(n-1)$ | $C_8 \cdot e_8(n)$ | $e_8(n-1)$ | $C'_8 \cdot e_8(n)$ |
| $T_{20}$ | * | * | $A_U \cdot O_{10}(n-1)$ | $A_U \cdot O_{10}(n-1)$ | $A_L \cdot O_{10}(n-1)$ | $e'_8(n)$ |
| $T_1$ | $C'_{1L}$ | $e_1(n+1)$ | * | * | * | $U(n-1)$ |

FIG. 21B

| ADDITION/SUBTRACTION CIRCUIT | | | SHIFT REGISTERS 34 & 110 | | | OUTPUT |
|---|---|---|---|---|---|---|
| A | B | | | 8BIT S.R. | 11BIT S.R. | |
| $e_1(n)$ | $e'_1(n-1)$ | $O_{10}(n-1)$ | $e_1(n)$ | $e'_1(n-1)$ | $e_8(n-2)$ | $U(n-2)$ |
| $-$ ✳ | ✳ | $e_3(n)$ | △ ✳ | $e'_1(n-1)$ | $e_9(n-2)$ | |
| $e_2(n)$ | $e'_2(n-1)$ | ✳ | $e_2(n)$ | $e'_2(n-1)$ | $e_9(n-2)$ | |
| $-$ ✳ | ✳ | $e_4(n)$ | △ ✳ | $e'_2(n-1)$ | $e_1(n-1)$ | |
| $e_3(n)$ | $e'_3(n-1)$ | ✳ | $e_3(n)$ | $e'_3(n-1)$ | $e_1(n-1)$ | |
| $-e'_1(n)$ | $V(n)$ | $e_5(n)$ | △ $e'_1(n)$ | $e'_3(n-1)$ | $e_2(n-1)$ | |
| $e_4(n)$ | $e'_4(n-1)$ | $O_1(n)$ | $e_4(n)$ | $e'_4(n-1)$ | $e_2(n-1)$ | |
| $-e'_2(n)$ | $O_1(n)$ | $e_6(n)$ | △ $e'_2(n)$ | $e'_4(n-1)$ | $e_3(n-1)$ | |
| $e_5(n)$ | $e'_5(n-1)$ | $O_2(n)$ | $e_5(n)$ | $e'_5(n-1)$ | $e_3(n-1)$ | |
| $-e'_3(n)$ | $O_2(n)$ | $e_7(n)$ | △ $e'_3(n)$ | $e'_5(n-1)$ | $e_4(n-1)$ | |
| $e_6(n)$ | $e'_6(n-1)$ | $O_3(n)$ | $e_6(n)$ | $e'_6(n-1)$ | $e_4(n-1)$ | |
| $-e'_4(n)$ | $O_3(n)$ | $e_8(n)$ | △ $e'_4(n)$ | $e'_6(n-1)$ | $e_5(n-1)$ | |
| $e_7(n)$ | $e'_7(n-1)$ | $O_4(n)$ | $e_7(n)$ | $e'_7(n-1)$ | $e_5(n-1)$ | |
| $-e'_5(n)$ | $O_4(n)$ | $e_9(n)$ | △ $e'_5(n)$ | $e'_7(n-1)$ | $e_6(n-1)$ | |
| $e_8(n)$ | $e'_8(n-1)$ | $O_5(n)$ | $e_8(n)$ | $e'_8(n-1)$ | $e_6(n-1)$ | |
| $-e'_6(n)$ | $O_5(n)$ | $e_{10}(n)$ | △ $e'_6(n)$ | $e'_8(n-1)$ | $e_7(n-1)$ | |
| $e_9(n)$ | $O_6(n)$ | $O_6(n)$ | $e_9(n)$ | ✳ | $e_7(n-1)$ | |
| $-e'_7(n)$ | $O_7(n)$ | $O_7(n)$ | △ $e'_7(n)$ | ✳ | $e_8(n-1)$ | |
| $e_{10}(n)$ | $C_8(n)$ | $O_8(n)$ | | ✳ | $e_8(n-1)$ | |
| $-e'_8(n)$ | $O_9(n)$ | $O_9(n)$ | △ $e'_8(n)$ | ✳ | $e_8(n-1)$ | ↓ |
| $e_1(n+1)$ | $e'_1(n)$ | $O_{10}(n)$ | $e_1(n+1)$ | $e'_1(n)$ | $e_8(n-1)$ | $U(n-1)$ |

FIG. 22A

| | $T_1$ | $T_2$ | $T_3$ | $T_4$ | $T_5$ | $T_6$ | $T_7$ | $T_8$ | $T_9$ | $T_{10}$ |
|---|---|---|---|---|---|---|---|---|---|---|
| $\phi_A$ | | | | ○ | | ○ | | ○ | | ○ |
| $\phi_B$ | | | | | ○ | | ○ | | ○ | |
| $\phi_C$ | ○ | | | | | | | | | |
| $\phi_D$ | ○ | | ○ | | ○ | | ○ | | ○ | |
| $\phi_E$ | | | | | | ○ | | | | |
| $\phi_F$ | | | | | | | | ○ | | ○ |
| $\phi_G$ | | | | | | | | | | |
| $\phi_H$ | | | | | | ○ | | ○ | | ○ |
| $\phi_I$ | ○ | | ○ | | | | | | | |
| $\phi_J$ | | | | | ○ | | ○ | | ○ | |
| $\phi_K$ | ○ | ○ | ○ | ○ | | | | | | |
| $\phi_L$ | | | | | ○ | ○ | ○ | ○ | ○ | ○ |
| $\phi_M$ | | | | | ○ | | ○ | | ○ | |
| $\phi_N$ | | ○ | | ○ | | ○ | | ○ | | ○ |
| $\phi_O$ | | | | | | | | | | |
| $\phi_P$ | | | ○ | | ○ | | ○ | | ○ | |

FIG. 22B

| $T_{11}$ | $T_{12}$ | $T_{13}$ | $T_{14}$ | $T_{15}$ | $T_{16}$ | $T_{17}$ | $T_{18}$ | $T_{19}$ | $T_{20}$ |
|---|---|---|---|---|---|---|---|---|---|
| | ○ | | ○ | | ○ | | ○ | | ○ |
| ○ | | ○ | | ○ | | ○ | | ○ | |
| | | | | | | | | | |
| ○ | | ○ | | ○ | | | | | |
| | | | | | | | | | |
| | ○ | | ○ | | ○ | | | | |
| | | | | | | ○ | ○ | ○ | ○ |
| | ○ | | ○ | | ○ | | ○ | | ○ |
| | | | | | | | | | |
| ○ | | ○ | | ○ | | ○ | | | |
| | | | | | | | | | |
| ○ | ○ | ○ | ○ | ○ | ○ | | | | |
| ○ | | ○ | | ○ | | ○ | | ○ | |
| | ○ | | ○ | | ○ | | ○ | | ○ |
| | | | | | | ○ | ○ | | |
| ○ | | ○ | | ○ | | | | | |

LSP VOICE SYNTHESIZER

BACKGROUND OF THE INVENTION

The present invention relates to a line spectrum pair voice synthesizer (to be referred to as an LSP speech synthesizer hereinafter) and, more particularly, to a compact LSP speech synthesizer which does not degrade voice sound quality.

Conventional speech synthesizers include a linear predictive coding (LPC) speech synthesizer and a partial correlation (PARCOR) speech synthesizer. Each of these speech synthesizers includes: a memory for storing parameters for creating speech sound waves and speech parameter information, such as speech segment data; a speech synthesizer for producing speech sound waves based on the speech parameter information and for converting them into sounds; a controller for reading out the speech parameter information and for driving the speech synthesizer on the basis of commands given thereto.

In the LPC speech synthesizer, speech is mathematically patterned using the principle of linear prediction, and highly precise speech synthesis is performed by using an analytic method which constantly yields a stable solution. However, if the LPC speech synthesizer is applied to speech information compression/transmission, speech synthesis characteristics of the filter are unstable when speech parameters are encoded to low-bit data. In order to improve upon the above drawback and utilize linear prediction for further practicability, a PARCOR speech synthesizer was developed.

In the PARCOR speech synthesizer, speech information for each second can be compressed into data of 4,800 to 9,600 bits. However, if speech information is less than 2,400 bit data/second, speech synthesis becomes abruptly unclear and unnatural.

In order to eliminate this drawback of the PARCOR system, an analysis theory using the LSP (Line Spectrum Pair) system was proposed. The LSP speech synthesis method was proposed based on this analysis theory. Immediately after the proposal of the LSP synthesis method, a one-chip LSP speech synthesizer LSI was developed.

In the LSP system, speech synthesis can be performed using a small amount of speech information and can maintain speech sound quality above a given level. However, since a conventional LSP speech synthesizer has a digital filter consisting of a shift register of about 300 bits, four series adders, a subtractor, and a pipeline multiplier, the synthesizer is large in size. In the pipeline multiplier, a master clock pulse frequency is 921.6 kHz (6.4 kHz$\times$144) if 144 clock pulses are used for one sampled value and a sampling frequency is 6.4 kHz. Such a high master clock pulse frequency results in high power consumption. Therefore, it is desirable that an LSP system use a lower-frequency master clock pulse.

SUMMARY OF THE INVENTION

It is, therefore, an object of the present invention to provide an LSP voice synthesizer suitable for an LSI.

It is another object of the present invention to provide an LSP voice synthesizer suitable for a one-chip LSI.

It is still another object of the present invention to provide an LSP voice synthesizer which consumes less power.

It is still another object of the present invention to provide an LSP voice synthesizer which allows easy circuit design.

It is still another object of the present invention to provide an LSP voice synthesizer which can be manufactured at low cost.

It is still another object of the present invention to provide an LSP voice synthesizer wherein a master clock pulse frequency is greatly decreased without degrading voice sound quality.

These and other objects of the present invention have been attained by an LSP voice synthesizer which comprises: a memory for storing various voice parameters necessary for LSP voice synthesis; controlling means, connected to said memory, for reading out a predetermined voice parameter in accordance with external input data; excitation means, connected to said controlling means, for producing excitation information in accordance with the predetermined voice parameter received from said controlling means; LSP voice synthesizing means, connected to said controlling and excitation means and comprising pluralities of parallel operating circuits, delay circuits and shift registers respectively, for performing LSP voice synthesis by processing in parallel operation the predetermined voice parameter received from said controlling means and the excitation information received from said excitation means; D/A converting means, connected to said LSP voice synthesizing means, for converting a digital output from said LSP voice synthesizing means to an analog signal; timing signal generating means, connected to said controlling means, said LSP voice synthesizing means and said excitation means, for generating a predetermined timing signal to each one of said controlling means, said LSP voice synthesizing means, and said excitation means, on the basis of a clock pulse entered from the outside.

According to the present invention, since LSP voice synthesis is performed by parallel-operating the voice parameter and excitation information, the sampling period of the voice sound is shortened. For example, in an embodiment described below, the sampling period of the voice sound corresponds to 23 or 20 clock pulses. The sampling period is thus very short as compared with the conventional sampling period which corresponds to 144 clock pulses. Therefore, the master clock frequency is 23/144 or 20/144 of the conventional frequency, which allows easy circuit design. Further, manufacturing cost is greatly decreased. As the master clock frequency is lowered, power consumption is decreased. Also, in a parallel operation to be described later, multiplication data is divided into upper bits and lower bits which are multiplied by the same multiplier at different timings. Thus, a compact multiplier can be used. Further, since an addition circuit of the digital filter is also used as an addition circuit which synthesizes partial products of the upper and lower bits, the LSP voice synthesizing means becomes compact given the circuit space of the addition circuit.

In this manner, the LSP voice synthesizer according to the present invention consumes less power and has compact LSP voice synthesizing means, so that it is suitable for an LSI or a one-chip LSI.

BRIEF DESCRIPTION OF THE DRAWINGS

By way of example and to make the description clearer, reference is made to the accompanying drawings in which:

FIGS. 3A, 3B and 3C are views showing synthesized signals at each point in FIG. 2;

FIGS. 5A to 5D are views showing data formats of speech parameters stored in an ROM in FIG. 4;

FIGS. 7A and 7B are views for explaining timings of various timing signals used in the circuit shown in FIGS. 6A and 6B;

FIGS. 8A and 8B are views showing input/output data of the main part in FIGS. 6A and 6B;

FIGS. 16A and 16B are views showing timings of timing signals used in the parameter converting circuit in FIGS. 15A and 15B;

FIGS. 18A and 18B are views showing input/output data of the main part in FIGS. 17A and 17B;

FIGS. 19A and 19B are views showing timings of timing signals sed in FIGS. 17A and 17B;

FIGS. 21A and 20B are views showing input/output data of the main part in FIGS. 20A and 20B; and FIGS. 22A and 20B are views showing timings of timing signals used with reference to FIGS. 20A and 20B.

DETAILED DESCRIPTION OF THE PREFERRED EMBODIMENTS

Figure 1:
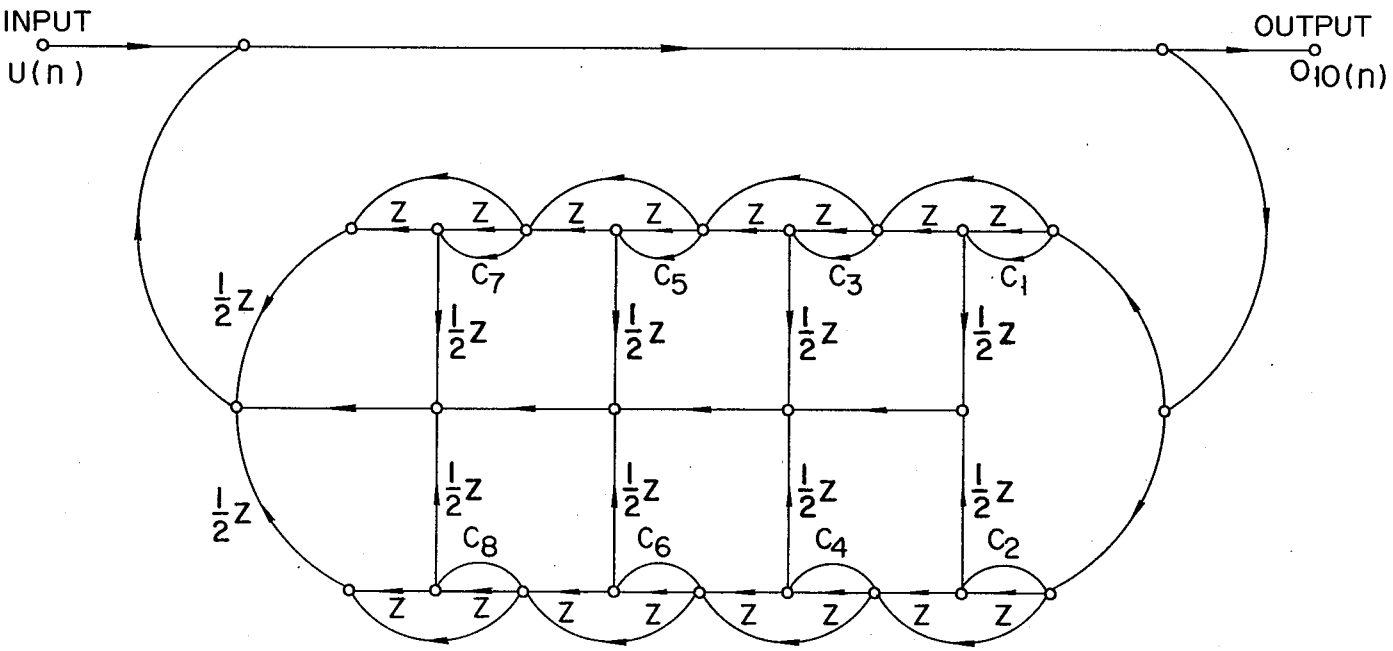
FIG. 1 (PRIOR ART)
FIG. 1 is a signal flow graph of an LSP speech synthesizer digital filter.

The principle of an LSP system will first be briefly described. Speech sounds are divided into voiced sounds and unvoiced sounds. The voiced sounds are produced as pulsed waves when air flowing from the lungs through a windpipe causes vocal chords to vibrate. The pulsed sound becomes an excitation signal of a vocal tract resonant system. The vocal tract resonance system is a type of acoustic filter and its frequency characteristics are determined by the cross sectional area of the vocal tract, which is determined by lips, tongue and jowls. One end of the vocal tract which is near the lips is open to the atmosphere, while the other end (glottis) thereof is closed/opened by vibration of the vocal chords. Assume that there are only two states of the glottis for illustrative simplicity: the fully open state and the completely closed state. (The above assumption does not follow actual glottis states, and in practice, the glottis is in a state somewhere between the fully open state and the completely closed state.) Further, assume that no energy loss occurs upon vibration of the vocal tract wall or by energy dissipation from the mouth. Therefore, a pair of resonant frequencies are determined which respectively correspond to sounds produced when the glottis is kept in the fully open state and the completely closed state. The pair of resonant frequencies are called a linear spectrum pair (LSP).

The LSP analysis and synthesis methods are described below. An all-pole digital filter is used as the vocal tract filter in the LPC, PARCOR and LSP systems. A transfer function H(Z) of the all-pole digital filter is given by the following equation:

$$H(Z)=1/A_p(z)\ (Z=e^{-j\omega}) \tag{1}$$

where p is the degree of the filter and $A_p(Z)=1+\alpha_1 Z+\alpha_z Z^2+\ldots+\alpha_p Z^p$. It is known that the denominator of equation (1), that is, the polynomial $A_p(Z)$, is produced by the following recursive formula.

$$\left.\begin{aligned} A_n(Z) &= A_{n-1}(Z) - k_n B_{n-1}(Z) \\ B_n(Z) &= Z(B_{n-1}(Z) - k_n A_{n-1}(Z)) \end{aligned}\right\} \tag{2}$$

for $A_O(Z)=1$ and $B_O(Z)=Z$ as initial conditions The parameter $k_n$ (n=1, 2, . . . , p) used in the above recursive formula is called a PARCOR coefficient. The fully open position and the completely closed position of the glottis are defined as maximum and minimum values, respectively. If $k_{p+1}=1$, then the maximum value is obtained, that is, the glottis is fully opened. However, if $k_{p+1}=-1$, then the minimum value is obtained, that is, the glottis is completely closed.

In the set of equations (2), if $n=p+1$, then the glottis is fully opened when $k_{p+1}=1$ and the glottis is completely closed when $k_{p+1}=-1$, as described above. Therefore, if zero points of the polynomials P(Z) and Q(Z) are obtained, the resonant frequencies and hence the LSP can be obtained.

$$\left.\begin{aligned} k_{p+1} &= 1: P_p(Z) = A_p(Z) - B_p(Z) \\ k_{p+1} &= -1: Q_p(Z) = A_p(Z) + B_p(Z) \end{aligned}\right\} \tag{3}$$

If the order of the filter is an even number, $$\left.\begin{aligned} P_p(Z) &= (1-Z)\,\pi\,(1-2Z\cos\omega_i+Z^2) \\ &\qquad i=2,4,\ldots p \\ Q_p(Z) &= (1+Z)\,\pi\,(1-2Z\cos\omega_i+Z^2) \\ &\qquad i=1,3,\ldots p-1 \end{aligned}\right\} \tag{4}$$

However, if the order of the filter is an odd number, $$\left.\begin{aligned} P_p(Z) &= (1-Z^2)\,\pi\,(1-2Z\cos\omega_i+Z^2) \\ &\qquad i=2,4,\ldots p-1 \\ Q_p(Z) &= \pi\,(1-2Z\cos\omega_i+Z^2) \\ &\qquad i=1,3,\ldots p \end{aligned}\right\} \tag{5}$$

where $\{\omega_i\}$ must satisfy the following relation:

$$0<\omega_1<\omega_2<\ldots<\omega_p$$

The coefficients $\omega_1, \omega_2, \ldots, \omega_p$ of factorization are called LSP.

To obtain the LSP from the speech sound is to obtain radicals which number P in the two polynomials (3). If P(Z) and Q(Z) are given, the two polynomials entail the following equation.

$$A_p(Z)=\{P_p(Z)+Q_p(Z)\}/2 \tag{6}$$

Equation (6) is substituted into equation (1) to determine the transfer function H(Z) of the vocal tract filter. The LSP of the vocal tract filter may be understood as the expression of the speech sound power spectrum $|H(Z)|^2$ by the density of positions of discrete frequencies $\{\omega_i\}$ which number P.

The main part of the speech synthesis is the vocal tract filter of the transfer function H(Z). When coefficients $\omega_1, \omega_2, \ldots, \omega_p$ are given in LSP speech synthesis, a digital filter corresponding to H(Z) is required. H(Z) is realized by a filter with a gain of $1-A_p(Z)$ in the negative feedback path. The gain $1-A_p(Z)$ is expressed in the following manner when $P_p(Z)$ and $Q_p(Z)$ in equations (4) and (5) are used.

If p is an even number, $$1-A_p(Z)= \tag{7}$$

$$\frac{Z}{2}\left[-\sum_{\substack{i=2\\(i=\text{even})}}^{p}(C_i+Z)\prod_{\substack{j=0\\(j=\text{even})}}^{i-2}(1+C_jZ+Z^2)+\prod_{\substack{i=2\\(i=\text{even})}}^{p}(1+C_iZ+Z^2)-\sum_{\substack{i=1\\(i=\text{odd})}}^{p-1}(C_i+Z)\prod_{\substack{j=-1\\(j=\text{odd})}}^{i-2}(1+C_jZ+Z^2)-\prod_{\substack{i=1\\(i=\text{odd})}}^{p-1}(1+C_iZ+Z^2)\right]$$

where
$C_i=-2\cos\omega_i$, and
$C_0=C_{-1}=-Z$

If p is an odd number, $$1-A_p(Z)= \tag{8}$$

$$\frac{Z}{2}\left[-\sum_{\substack{i=2\\(i=\text{even})}}^{p-1}(C_i+Z)\prod_{\substack{j=0\\(j=\text{even})}}^{i-2}(1+C_iZ+Z^2)+Z\prod_{\substack{i=2\\(i=\text{even})}}^{p-1}(1+C_iZ+Z^2)-\sum_{\substack{i=1\\(i=\text{odd})}}^{p}(C_i+Z)\prod_{\substack{j=-1\\(j=\text{odd})}}^{i-2}(1+C_iZ+Z^2)\right]$$

where
$C_i=-2\cos\omega_i$, and
$C_0=C_{-1}=-Z$

Figure 2:
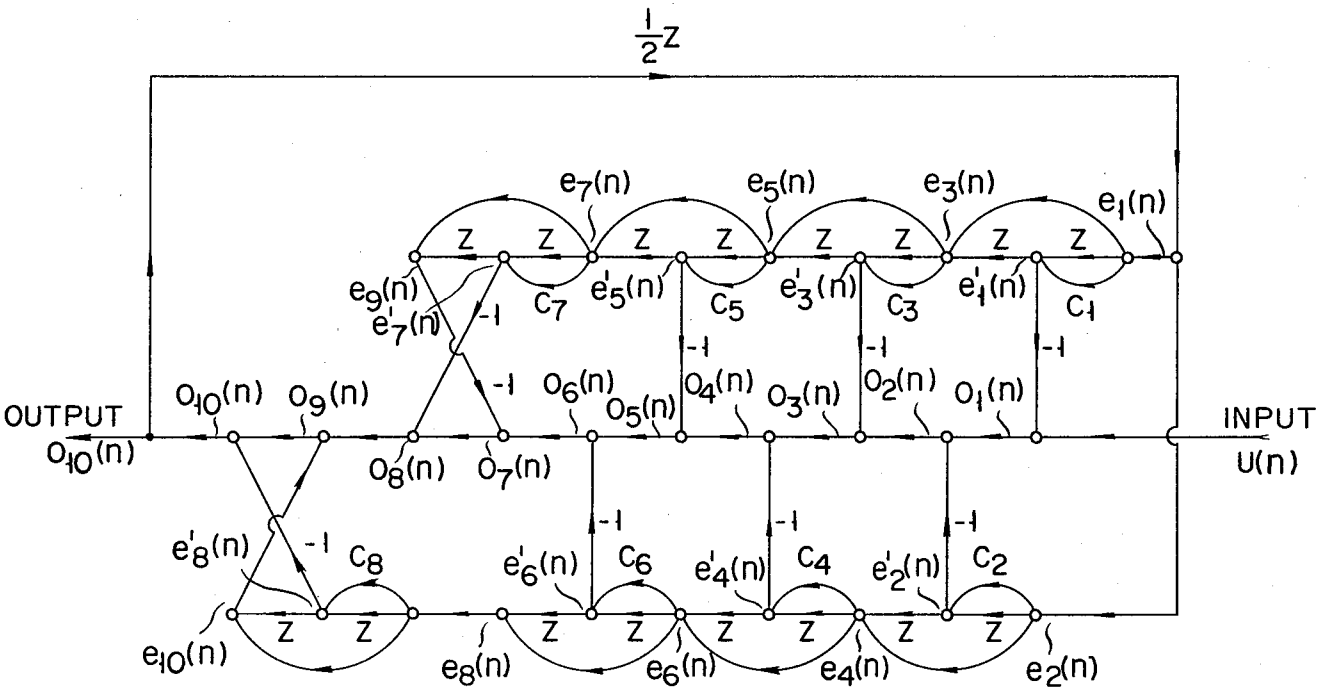
FIG. 2 (PRIOR ART)
FIG. 2 is a signal flow graph showing the signals shown in FIG. 1 in a hardware manner.

FIG. 1 is a signal flow graph of the LSP speech synthesizer digital filter when p=8 is given in equation (7). In the above signal flow graph, the central line in the negative feedback path indicates first and third terms in the brackets in equation (7). The upper line indicates a fourth term in the brackets, while the lower line indicates a second term therein. FIG. 2 shows the signal flow chart in FIG. 1 in a hardware manner. FIG. 3 shows synthesized signals at points e1(n) to e10(n), e'1(n) to e'8(n) and O1(n) to O10(n) shown in FIG. 2. Referring to FIG. 3, e1(n) or O10(n) is a final speech output.

Figure 4:
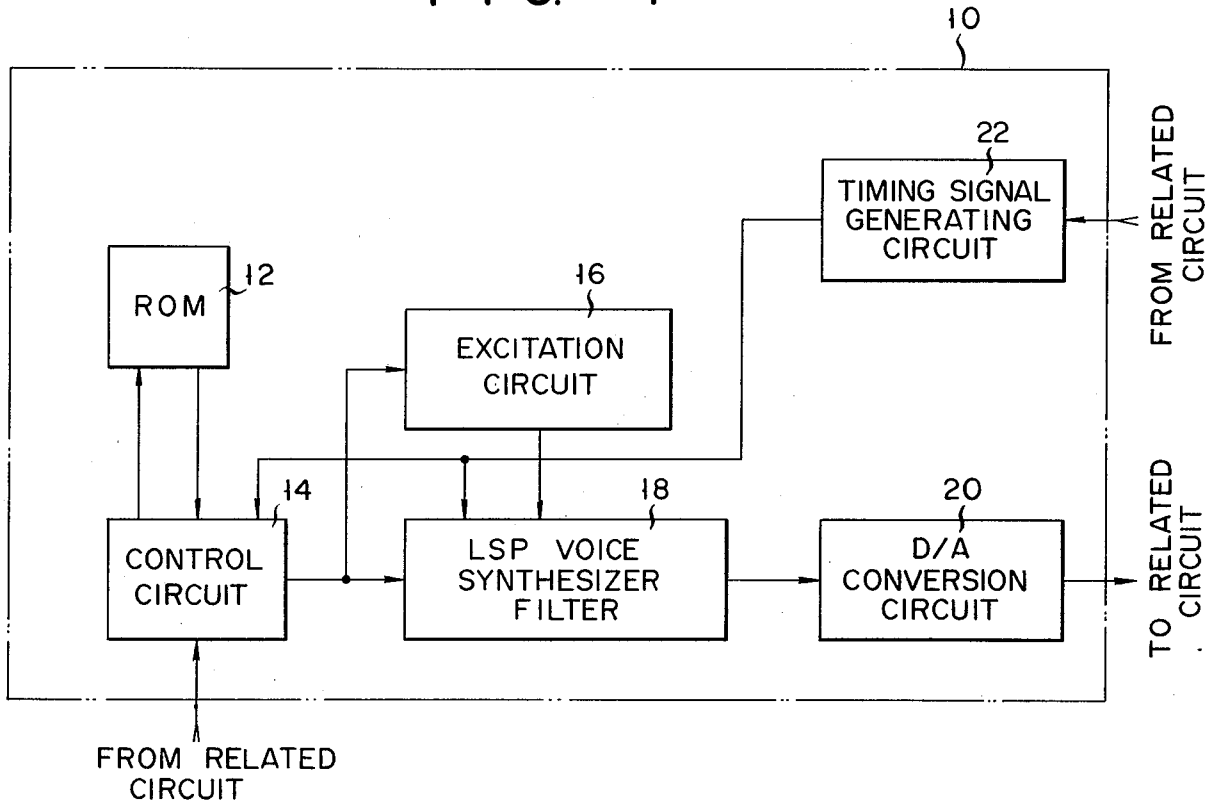
FIG. 4 is a block diagram schematically showing a one-chip LSP speech synthesizer LSI as used for illustrating an LSP voice synthesizer.

The detailed arrangement of the LSP speech synthesizer device will be described. FIG. 4 shows a one-chip LSP speech synthesizer LSI 10 which comprises CMOSs. The LSP speech synthesizer LSI 10 is constituted by a read-only memory (ROM) 12 for storing various speech parameters, a control circuit 14 for controlling each section in accordance with external input data, an excitation circuit 16 for producing excitation information, an LSP speech synthesizer filter 18 for performing LSP speech synthesis in accordance with the speech parameters which are read out from the ROM 12 through the control circuit 14 and the excitation information from the excitation circuit 16, a D/A conversion circuit 20 for converting a digital output from the LSP speech synthesizer filter 18 to an analog signal, and a timing signal generating circuit 22 for generating various timing signals on the basis of clock pulses entered from the outside.

In the speech synthesizer device, the bandwidth of the synthesized speech signal is 4 kHz and the sampling period thereof is 8 kHz. Therefore, the master clock pulse frequency to be described later is 184 kHz (=8 kHz×23).

Speech parameters shown in FIGS. 5A to 5D are stored in the ROM 12. Data is read out in units of 4 bits. In particular, FIG. 5A shows a data format for specifying an unvoiced interval. This data format consists of 2-bit sync. data and 6-bit unvoiced frame data. The number of frames for the unvoiced interval is specified in the unvoiced interval memory area. FIG. 5B shows a data format for a voiced interval if a pitch is an initial value. This data format consists of 2-bit sync. data, 6-bit amplitude data, 7-bit pitch period data, 1-bit sync. data for the 7-bit pitch period data, and 4-bit data respectively for LSP parameters $\omega_1$ to $\omega_8$. Thus, the data format has a total of 48 bits. FIG. 5C shows a data format of a voiced frame when a pitch indicates a difference, while FIG. 5D shows a data format of an unvoiced frame. The data format in FIG. 5D is the same as that in FIG. 5B except that 4 bits are decreased from the data length of the pitch. Thus, the data format in FIG. 5D has a total of 44-bits. Three-bit pitch data in FIGS. 5C and 5D indicates a pitch difference and an unvoiced code, respectively. Referring to FIGS. 5B to 5D, the 2-bit sync. data is used to control the frame length. For example, if data is a logical value of "00", it indicates 128 sounds/frame. If data is "01", it indicates 256 sounds/frame. Further, if data is "10", it indicates 512 sounds/frame. If data is "11", it indicates the unvoiced interval. The 1-bit sync. data is used to determine the state of the pitch. If data is a logical value of "1", it indicates that the pitch is the initial value, while if data is "0", it indicates the pitch difference. The 3-bit pitch data indicates a length (difference) with respect to the voiced frame and takes logical values of "101" to "011". If data is "100", it indicates the unvoiced frame.

Figure 6A:
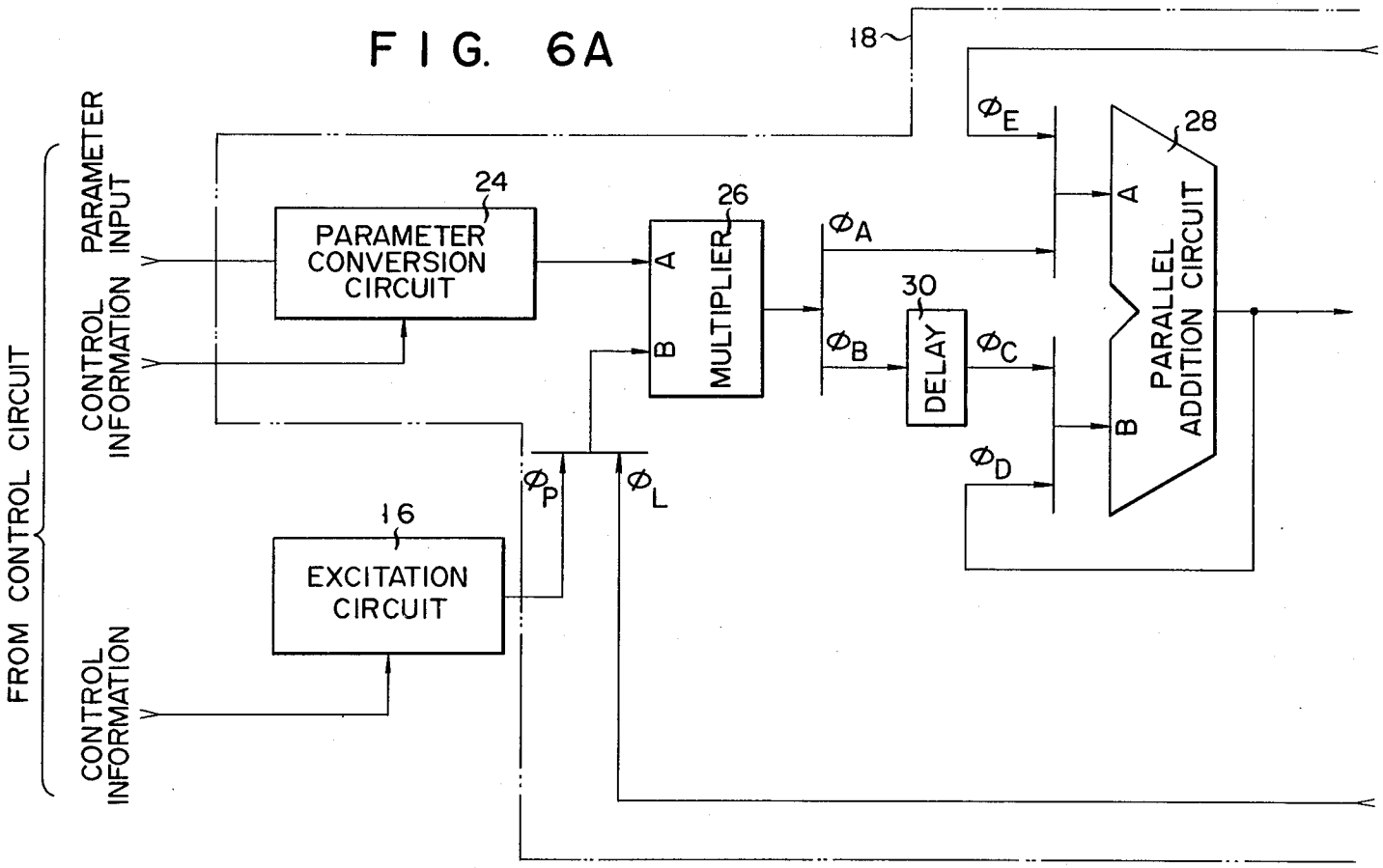
FIGS. 6A and 6B are detailed block diagrams of an LSP speech synthesizer digital filter in FIG. 4.
Figure 6B:
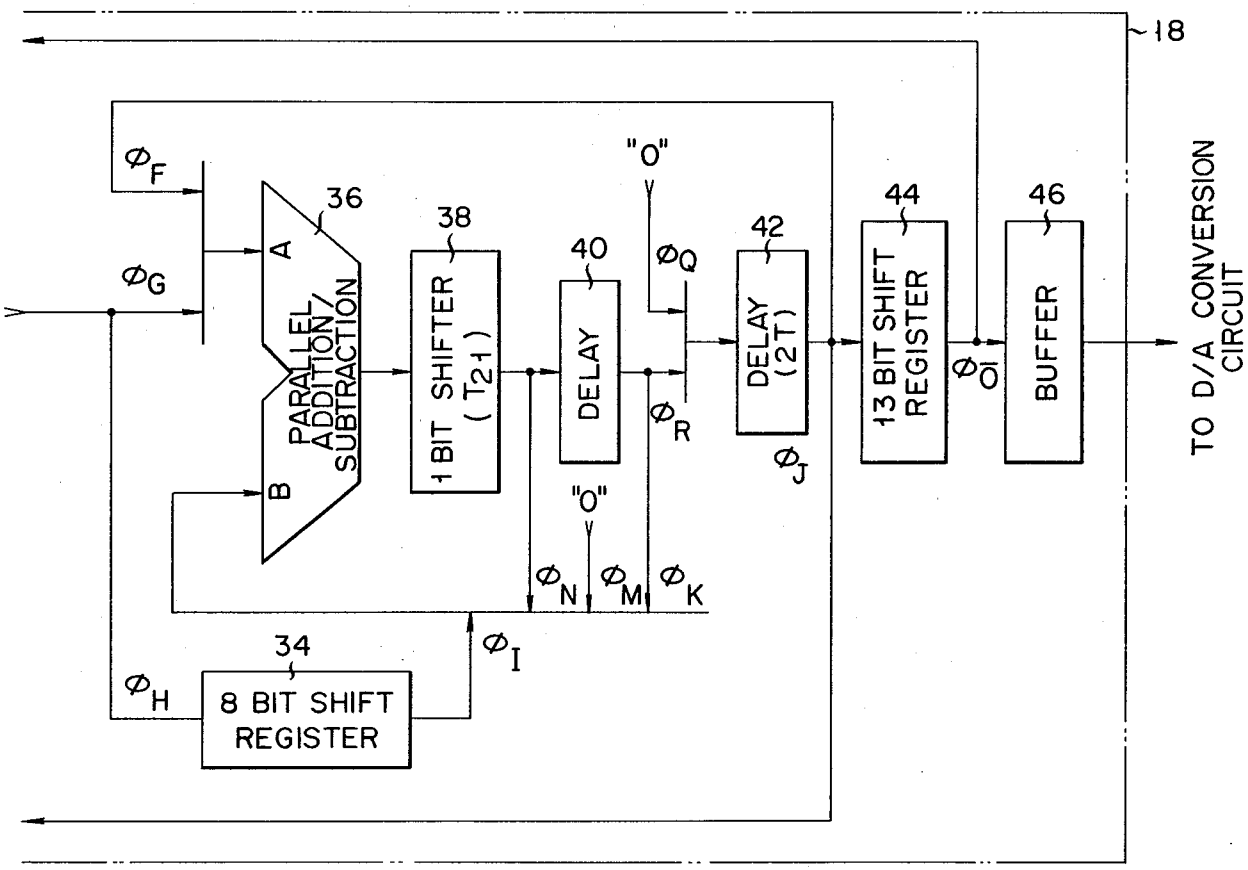

The detail of the LSP speech synthesizer filter 18 in FIG. 4 will be described with reference to FIGS. 6A and 6B. A parameter conversion circuit 24 interpolates a parameter read out from the ROM 12 through the control circuit 14 in synchronism with a timing signal and supplies a 7-bit output to an input terminal A of a multiplier 26. The excitation circuit 16 is operated in response to commands such as a voiced/unvoiced control command and a pitch period command which are entered through the control circuit 14. The excitation circuit 16 then generates voiced information or unvoiced information by interpolating the pitch period, and a detail thereof will be described later. 15-bit excitation information produced from the excitation circuit 16 is supplied to an input terminal B of the multiplier 26 in synchronism with a timing signal $\phi$P. The multiplier 26 has a 15-bit parallel multiplying function. A multiplication output from the multiplier 26 is supplied to an input terminal A of a 15-bit parallel addition circuit 28 in synchronism with a timing signal $\phi$A and also to a 1-bit delay circuit 30 in synchronism with a timing signal $\phi$B. An output from the delay circuit 30 is supplied to an input terminal B of the addition circuit 28 in synchronism with a timing signal $\phi$C. Further, an output from the addition circuit 28 is supplied to the input terminal B thereof in synchronism with a timing signal $\phi$D and to an input terminal A of a 15-bit parallel addition/subtraction circuit 36 in synchronism with a timing signal $\phi$G. The output from the parallel addition circuit 28 is also supplied to an 8-bit shift register 34 in synchronism with a timing signal $\phi$H. An output from the shift register 34 is supplied to an input terminal B of the addition/-subtraction circuit 36 in synchronism with a timing signal $\phi$I. An output from the addition/subtraction circuit 36 is output through a 1-bit shifter 38 which is operative only at time T21 and is supplied to an input terminal B of the addition/subtraction circuit 36 in synchronism with a timing signal $\phi$N. Further, a signal of level "0" is supplied to the input terminal B of the addition/subtraction circuit 36 in synchronism with a timing signal $\phi$M. The output from the shifter 38 is output through a 1-bit delay circuit 40 and is supplied to the input terminal B of the addition/subtraction circuit 36 in synchronism with a timing signal $\phi$K and to a 2T delay circuit 42 in synchronism with a timing signal $\phi$R. The delay circuit 42 also receives a signal of level "0" in synchronism with a timing signal $\phi$Q. An output from the delay circuit 42 is supplied to the input terminal B of the multiplier 26 in synchronism with a timing signal $\phi$L and to the input terminal A of the addition/subtraction circuit 36 in synchronism with a timing signal $\phi$F. The output from the delay circuit 42 is also supplied to a 13-bit shift register 44 in synchronism with a timing signal $\phi$J. An output from the shift register 44 is supplied to the input terminal A of the addition circuit 28 in synchronism with a timing signal $\phi$E and is transferred to a buffer 46 in synchronism with a timing signal $\phi$0. The contents retained in the buffer 46 are supplied as the final synthesized speech output to the D/A converter 20.

The cycle of the LSP speech synthesizer filter 18 FIGS. 7A and 7B. The timing signals $\phi$A to $\phi$R are generated at timings respectively indicated by a circle. Note that the addition/subtraction circuit 36 performs subtraction (B−A) at time T6, time T8, time T10, time T12, time T14, time T16, time T18 and time T20 and that it performs addition (A+B) at any other time.

Figures 9A, 9B, 9C:
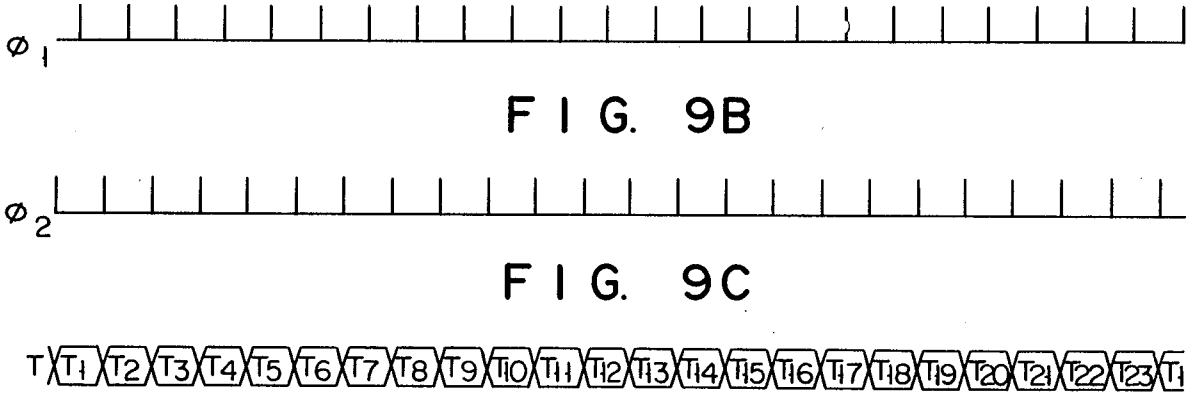
FIGS. 9A to 9C are views showing the relationship between the master clocks and timings.

The LSP speech filter 18 with the above arrangement performs an operation which corresponds to the algorithm shown in FIG. 3. FIGS. 8A and 8B show input-/output data of the multiplier 26, the addition circuit 28, the addition/subtraction circuit 36, the shift registers 34 and 44, and the buffer 46, at time T1 to time T23. Referring to FIG. 8B, a triangular mark indicates an input to the 8-bit shift register 34, while unmarked data indicates an input to the 13-bit shift register 44. As shown in FIGS. 9A, 9B and 9C, the LSP speech synthesizer filter 18 is operated by two-phase clock pulses $\phi$1 and $\phi$2. The clock pulse $\phi$1 is used for writing, while the clock pulse $\phi$2 is used for readout. The clock pulse $\phi$2 is generated at times T1 to T23. The mode of operation of the LSP speech synthesizer filter 18 will be described with reference to FIGS. 7A and 7B and FIGS. 8A and 8B. The parameter conversion circuit 24 divides respective 10-bit parameters $C_1$ to $C_8$ into upper 7 bits $C_U$ to $C_{8U}$ and lower 7 bits $C_{1L}$ to $C_{8L}$ as will be described in detail later. The parameter conversion circuit 24 supplies them to the input terminal A of the multiplier 26 at times T1 to time T16, as shown in FIG. 8A. Similarly, the parameter conversion circuit 24 divides speech amplitude information A into the upper 7 bits and lower 7 bits and supplies upper-bit speech amplitude information $A_U$ at time T22, while it supplies lower-bit speech amplitude information $A_L$ at time T23. An output from the parameter conversion circuit 24 is set to level "0" at times T17 to time T21. Meanwhile, the excitation circuit 16 supplies excitation information V(n) to the input terminal B of the multiplier 26 in synchronism with the clock pulse $\phi$P, that is, at time T22 and time T23. The outputs e1(n) to e8(n) from the delay circuit 42 are supplied to the input terminal B of the multiplier 26 in synchronism with the timing signal $\phi$L. At time T22, the upper-bit amplitude information $A_U$ is supplied to the input terminal A of the multiplier 26, while the excitation information V(n) is supplied to the input terminal B thereof. Thus, multiplication is initiated. At time T23, the lower-bit speech amplitude information $A_L$ is multiplied by the excitation information V(n) in the multiplier 26. The multiplier 26 requires an operating time interval corresponding to 2 bits. The multiplication result $A_U \cdot V(n)$ obtained by the data input at time T22 is produced at time T1 of the next cycle, while the multiplication result $A_L \cdot V(n)$ obtained by the data input at time T23 is produced at time T2 of the next cycle. The multiplication result $A_U \cdot V(n)$ produced at time T1 is supplied to the delay circuit 30 in synchronism with timing signal $\phi$B. The result is then 1-bit delayed and supplied to the input terminal B of the addition circuit 28 in synchronism with the timing signal $\phi$C at time T2. The multiplication result $A_L \cdot V(n)$ produced from the multiplier 26 at time T2 is directly supplied to the input terminal A of the addition circuit 28 in synchronism with the timing signal $\phi$A. Therefore, in the addition circuit 28, addition "$A_U \cdot V(n-)+A_L \cdot V(n)$" is performed at time T2. The sum U(n) is 1-bit delayed and is produced from the addition circuit 28. The sum U(n) is supplied to the input terminal B of the addition circuit 28 in synchronism with the timing signal $\phi$D at time T3. At this time, the input terminal A of the addition circuit 28 is set to low level, and the sum U(n) of the input terminal B is 1-bit delayed and is produced by the addition circuit 28 at time T4. The sum U(n) is supplied to the input terminal A of the addition/-subtraction circuit 36 in synchronism with $\phi$G. The input terminal B of the addition/subtraction circuit 36 is set to low level at time T4. Therefore, the sum U(n) supplied to the input terminal A is 1-bit delayed and is produced by the addition/subtraction circuit 36 at time T5. An output from the addition/subtraction circuit 36 passes through the shifter 38 itself at times after time T21. The output is then 1-bit delayed and is supplied to the input terminal A of the addition/subtraction circuit 36 in synchronism with the timing signal $\phi$K at time T6. Simultaneously, the output e'1(n) from the addition circuit 28 is supplied to the input terminal A of the addition/subtraction circuit 36 in synchronism with the timing signal $\phi$G. Since the subtraction command is supplied to the addition/subtraction circuit 36 at time T6, it performs subtraction "U(n)−e'1(n)" and produces a 1-bit delayed subtraction output O1(n). In the same manner as described above, the addition/subtraction circuit 36, which receives the timing signal $\phi$K at time T6, time T8, time T10, time T12, time T14 and time T16, produces an output which is 1-bit delayed by the delay circuit 40 and then supplied to the input terminal B thereof. A value corresponding to the output from the addition circuit 28 is subtracted from a value corresponding to the 1-bit delayed output described above. By the subtraction operation described above, the addition/subtraction circuit 36 produces outputs O1(n) to O6(n) at time T7, time T9, time T11, time T13, time T15, and times T17, respectively. From time T17 to time T22, the timing signal $\phi$N is generated so that the output from the addition/subtraction circuit 36 immediately passes through the shifter 38 and is supplied to the input terminal B of the addition/subtraction circuit 36. In this case, at time T17 and time T19, respectively, the outputs e9(n) and e10(n) from the delay circuit 42 are supplied to the input terminal A of the addition/subtraction circuit 36 in synchronism with the timing signal $\phi$F. At times T18 and T20, respectively, the outputs e'7(n) and e'8(n) from the addition circuit 28 are supplied to the input terminal A of the addition/subtraction circuit 36 in synchronism with the timing signal $\phi$G. The addition/subtraction circuit 36 performs addition at time T17 and time T19, while it performs subtraction at time T18 and time T20. The 1-bit delayed outputs O7(n) to O10(n) are produced from the addition/subtraction circuit 36. For example, the output O10(n) is produced by the addition/subtraction circuit 36 at time T21. The output is then shifted to the lower position by 1 bit by the shifter 17. The value of the shifted output becomes $\frac{1}{2}$, that is, e1(n), and the output e1(n) returns to the input terminal B of the addition/subtraction circuit 36.

Meanwhile, the output from the addition circuit 28 is supplied to the shift register 34 in synchronism with the timing signal $\phi$H. The shift register 34 sequentially shifts the storage contents every time it receives an input. After an 8-bit shift is performed, the shift register 34 produces an output. Since data is written in in response to the clock pulse $\phi$1 when the timing signal $\phi$H is produced, while data is read out in response to the clock pulse $\phi$2, the input/output signals of the shift register 34 are changed as shown in FIG. 8B. The outputs from the shift register 34 are supplied as the signals e'1(n−1) to e'8(n−1) to the input terminal B of the addition/subtraction circuit 36 at times corresponding to odd numbers from time T1 to T15, that is, in synchronism with the timing signal $\phi$I. Further, at times corresponding to odd numbers, the outputs e1(n) to e8(n) from the delay circuit 42 are supplied to the input terminal A of the addition/subtraction circuit 36 in synchronism with the timing signal $\phi$F. At the times corresponding to odd numbers, the addition/subtraction circuit 36 performs addition. The addition results e3(n) to e10(n) are 1-bit delayed and are produced at times corresponding to even numbers such as time T2, time T4, . . . , and time T16. The output from the addition/subtraction circuit 36 is transferred to the delay circuit 42 in synchronism with the timing signal $\phi$R via the delay circuit 40. By the delay circuit 42, the input data is 2-bit delayed and is retained for a time interval corresponding to the next one bit. Data is written in the delay circuit 42 in synchronism with the clock pulse $\phi$1 at time T1, time T3, time T5, time T7, time T9, time T11, time T13, time T15, time T17, time T19, time T20 and time T22, and is read out in synchronism with the clock pulse $\phi$2 at time T3, time T5, time T7, time T11, time T13, time T15, time T19, time T22 and time T1. The output from the delay circuit 42 is supplied to the input terminal A of the addition/subtraction circuit 36 in synchronism with the timing signal $\phi$F, and to the input terminal B of the multiplier 26 in synchronism with the timing signal $\phi$L. The output from the delay circuit 42 is also supplied to the shift register 44 in synchronism with the timing signal $\phi$J. The shift register 44 sequentially shifts the storage contents and produces an output when the storage contents are shifted by 13 bits. Data is written in the shift register 44 in response to the clock pulse $\phi$1 when the timing signal $\phi$J is produced, while data is read out therefrom in response to the clock pulse $\phi$2. Therefore, the shift register 44 produces an output e10(n−2) at time T1, an output of level "0" at time T2 and time T3, and the outputs e1(n−1) to e10(n−1) at times T4 to T23. An output from the shift register 44 is supplied to the input terminal A of the addition circuit 28 in synchronism with the timing signal $\phi$E. The output e1(n−1) is written in the buffer in synchronism with the timing signal $\phi$O at time T5. The output e1(n−1) is retained as the speech output until time T5 of the next cycle and is then supplied to the D/A conversion circuit 20 in which the data e1(n−1) is converted to an analog signal.

Figure 10:
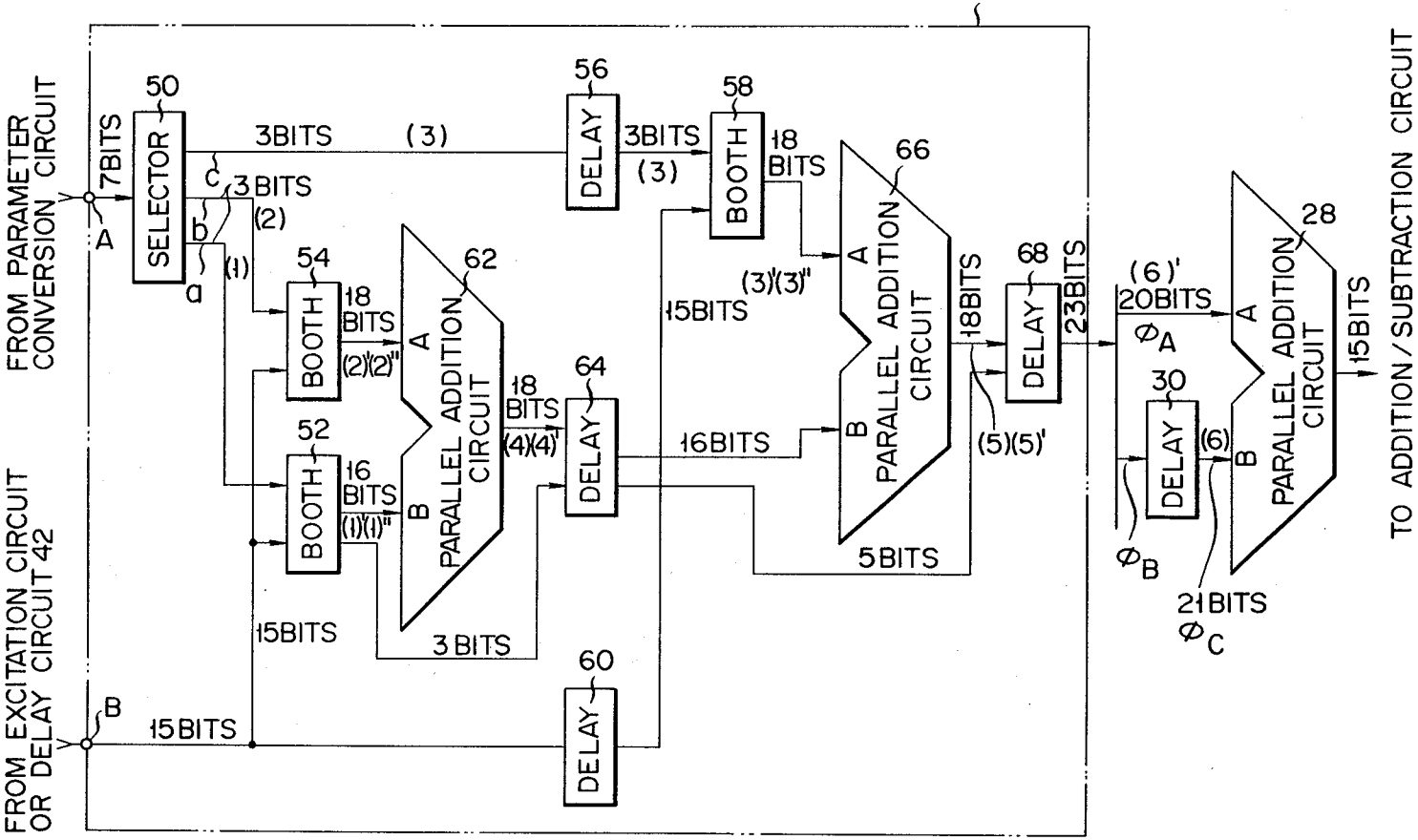
FIG. 10 is a detailed block diagram of a multiplier in FIG. 6A.

The arrangement of the multiplier 26 will be described in detail with reference to FIG. 10. Seven-bit data from the parameter conversion circuit 24 is supplied to the input terminal A of the multiplier 26. The data is divided into 3-bit data in a selector 50 and 3-bit data is output from output lines a to c. Data output from the output lines a and b of the selector 50 are respectively supplied to 2-bit Booth multipliers 52 and 54, while data output from the output line c is supplied to a 2-bit Booth multiplier 58 through a delay circuit 56. Meanwhile, 15-bit data supplied to the input terminal B of the multiplier 26 is supplied to the multipliers 52 and 54 and to the multiplier 58 through a 1-bit delay circuit 60. The multiplier 52 divides an operation result into upper 16 bits and lower 3 bits and produces 16-bit data and 3-bit data. The 16-bit data is supplied to an input terminal B of a parallel addition circuit 62, while the 3-bit data is supplied as lower-bit input from the least significant bit to the 3rd bit to the 1-bit delay circuit 64. The multiplier 54 also supplies the operation result of 18 bits to the addition circuit 62. Eighteen-bit addition data from the addition circuit 62 is supplied as upper-bit data from the 4th bit to the 21st bit to the delay circuit 64. The delay circuit 64 which receives data totalling 21 bits from two input terminals thereof divides it into upper 16 bits and lower 5 bits. Sixteen-bit data is supplied to an input terminal B of a parallel addition circuit 66, while 5-bit data is supplied as lower-bit data to a 1-bit delay circuit 68. The addition circuit 66 adds the output supplied by the multiplier 58 and received at its input terminal A and the data supplied by the delay circuit 64 and received at its input terminal B. As a result, 18-bit data from the addition circuit 66 is supplied as the upper-bit data to the delay circuit 68. Twenty-three-bit data from the delay circuit 68 becomes an output from the multiplier 26, and is supplied to the input terminal A of the addition circuit 28 in FIG. 6A and also to the input terminal B of the addition circuit 28 through the delay circuit 30.

Figure 11:
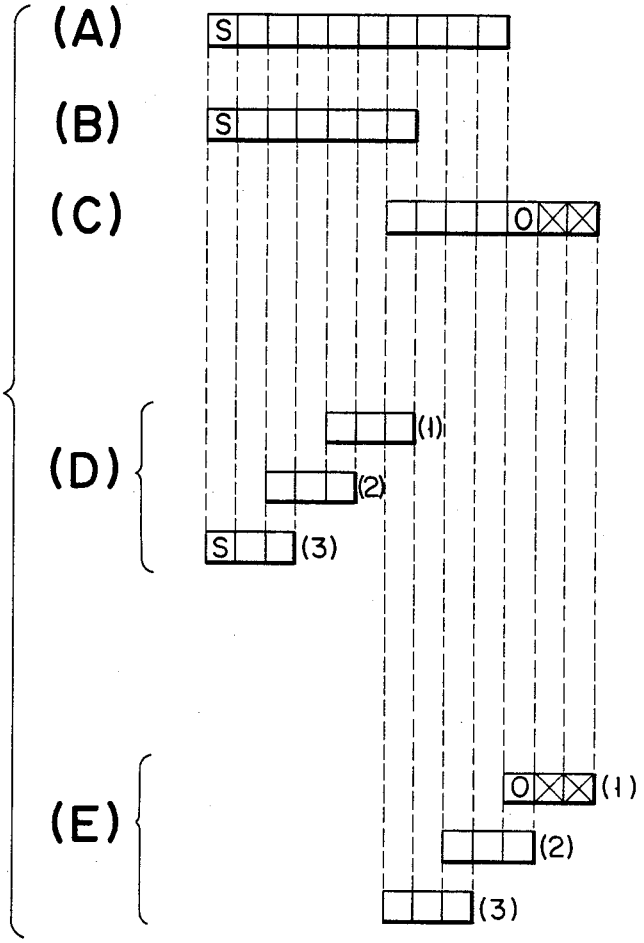
FIGS. 11A to 11E are views showing the divided state of multiplication data in the multiplier in FIG. 10.
Figure 12:
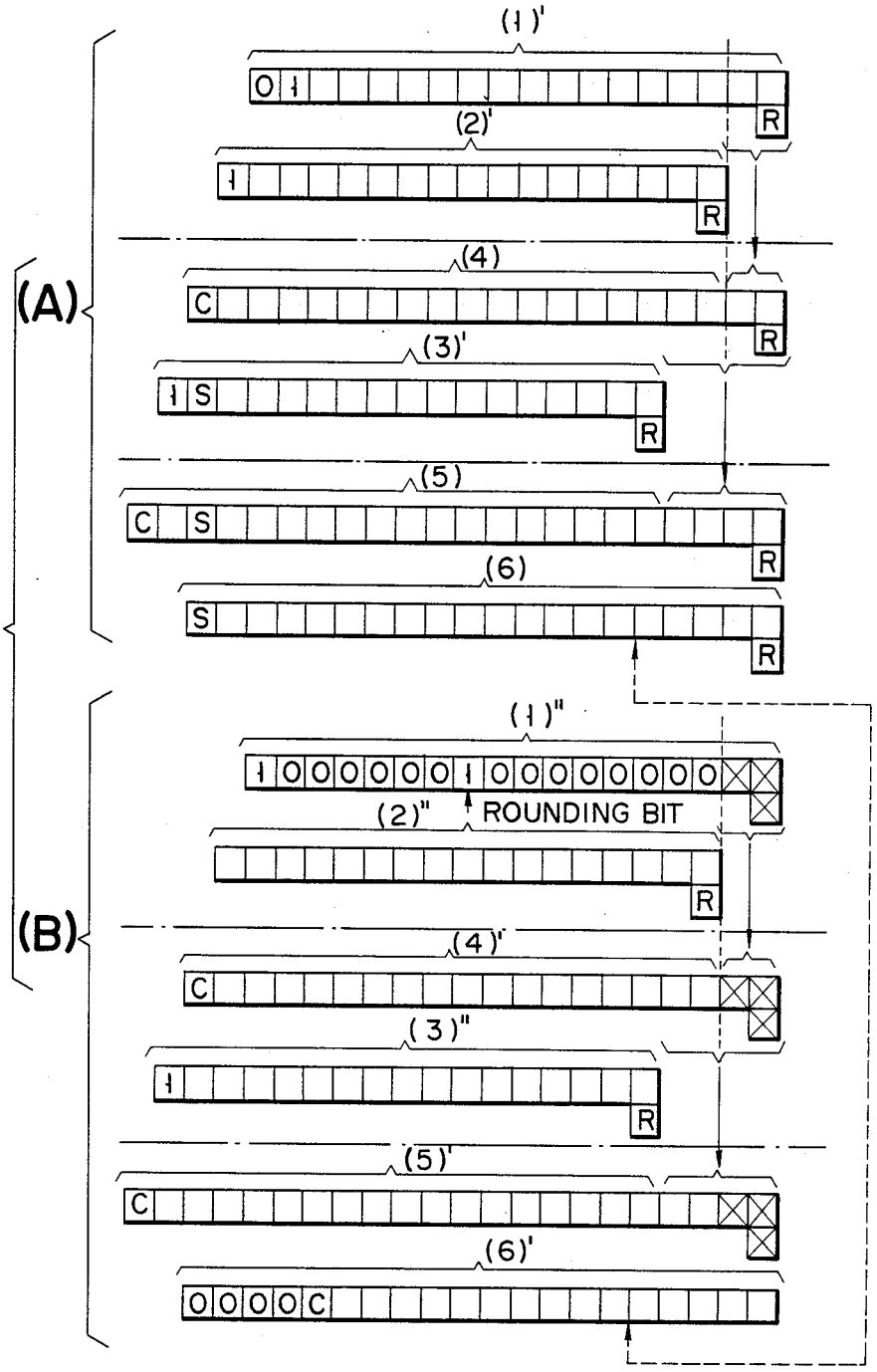
FIGS. 12A and 12B are views showing input/output data of each part in the multiplier in FIG. 10.

Ten-bit data (FIG. 11A) from the parameter conversion circuit 24 is divided to upper 7 bits and lower 7 bits, as shown in FIGS. 11B and 11C, and these data are supplied to the multiplier 26 with the above arrangement. In the data of lower 7 bits, the LSB (least significant bit) and the next bit have no meaning and a logical value of "0" is always stored in the third-from-last bit, as shown in FIG. 11C. The upper- and lower-bit data from the parameter conversion circuit 24 which are supplied to the input terminal A of the multiplier 28 are divided to be 3-bit data in the selector 50, as shown in (1) to (3) of FIG. 11D. Data output from the output lines a and b of the selector 50 are supplied to the Booth multipliers 52 and 54 and are multiplied by the 15-bit data supplied from the input terminal B of the multiplier 26 in synchronism with the timing signal $\phi$P or $\phi$L. The multiplier 52 divides 19-bit data into upper 16 bits and lower 3 bits, shown in (1') of FIG. 12A, for the data of upper 7 bits from the parameter conversion circuit 24. In this case, a rounding bit R is stored in the LSB, while a logical value of "0" is stored in the most significant bit (MSB) and "1" is stored in the next bit. The multiplier 52 divides data shown in (1'') of FIG. 12B for the set of lower 7 bits from the parameter conversion circuit 24. In response to the upper- and lower-bit data, the multiplier 54 produces 18-bit data respectively shown in (2') and (2'') of FIGS. 12A and 12B. Data output from the output line c of the selector 50 is supplied to the multiplier 58 through the delay circuit 56. This data is multiplied by the output from the delay circuit 60. The multiplier 58 generates 18-bit data respectively shown in (3') and (3'') of FIGS. 12A and 12B in response to the upper- and lower-bit data and supplies them to the input terminal A of the addition circuit 66. The 16-bit output from the multiplier 52 is added to the 18-bit output from the multiplier 54 in the addition circuit 62. The addition results are shown as 18-bit outputs in (4) and (4') of FIGS. 12A and 12B. The 18-bit output from the addition circuit 62 is synthesized with the 3-bit output from the multiplier 52 to produce 21-bit data in the delay circuit 64. The 21-bit data is then divided into data of upper 16 bits and data of lower 5 bits, and they are produced by the delay circuit 64. The 16-bit data from the delay circuit 64 is added to the 18-bit outputs shown in (3') and (3'') in the addition circuit 66 to produce 18-bit data shown in (5) and (5') of FIGS. 12A and 12B. The 18-bit data in (5) and (5') are then supplied to the delay circuit 68 and are synthesized with the 5-bit data output from the delay circuit 64 to produce 23-bit data. The 23-bit data from the delay circuit 68 is the final output of the multiplier 26. In the 23-bit data output from the delay circuit 68 at the timings for the upper-bit data, the lower 21 bits below a sign bit S are read into the delay circuit 30 in synchronism with the timing signal $\phi$B, and 21-bit data is delayed by 1 bit. As a result, data shown in (6) of FIG. 12A is produced and supplied to the addition circuit 28. Meanwhile, in the 23-bit data output from the delay circuit 68 at the timings for the lower-bit data, the upper 20 bits are selected in synchronism with the timing signal $\phi$A to produce data shown in (6') of FIG. 12B. The data in (6') is then supplied to the input terminal A of the addition circuit 28. In the data shown in (6'), the bits below the carry signal c stored in the MSB of the data in (5') are shifted to the right by 5 bits. At the same time, signals of level "0" are stored in the upper 4 bits. Thus, weighting is performed in correspondence to the data in (6). In the addition circuit 28, the upper-bit data in (6) is added to the lower-bit data in (6') in synchronism with the timing signal $\phi$A. The addition data of upper 15 bits is generated from the addition circuit 28.

The multiplier 26 performs parallel multiplication of input data received at the input terminals A and B thereof during a period of 2T, and supplies the multiplication result to the addition circuit 28. Since data is written in the delay circuits 56, 60, 64 and 68 in response to the clock pulse $\phi$1 shown in FIGS. 9A to 9C, while it is read out therefrom in response to the clock pulse $\phi$2, it takes a period of 1T to input data to the delay circuits 56, 60 and 64, and a further period of 1T to input the data to the delay circuit 68.

Figure 13:
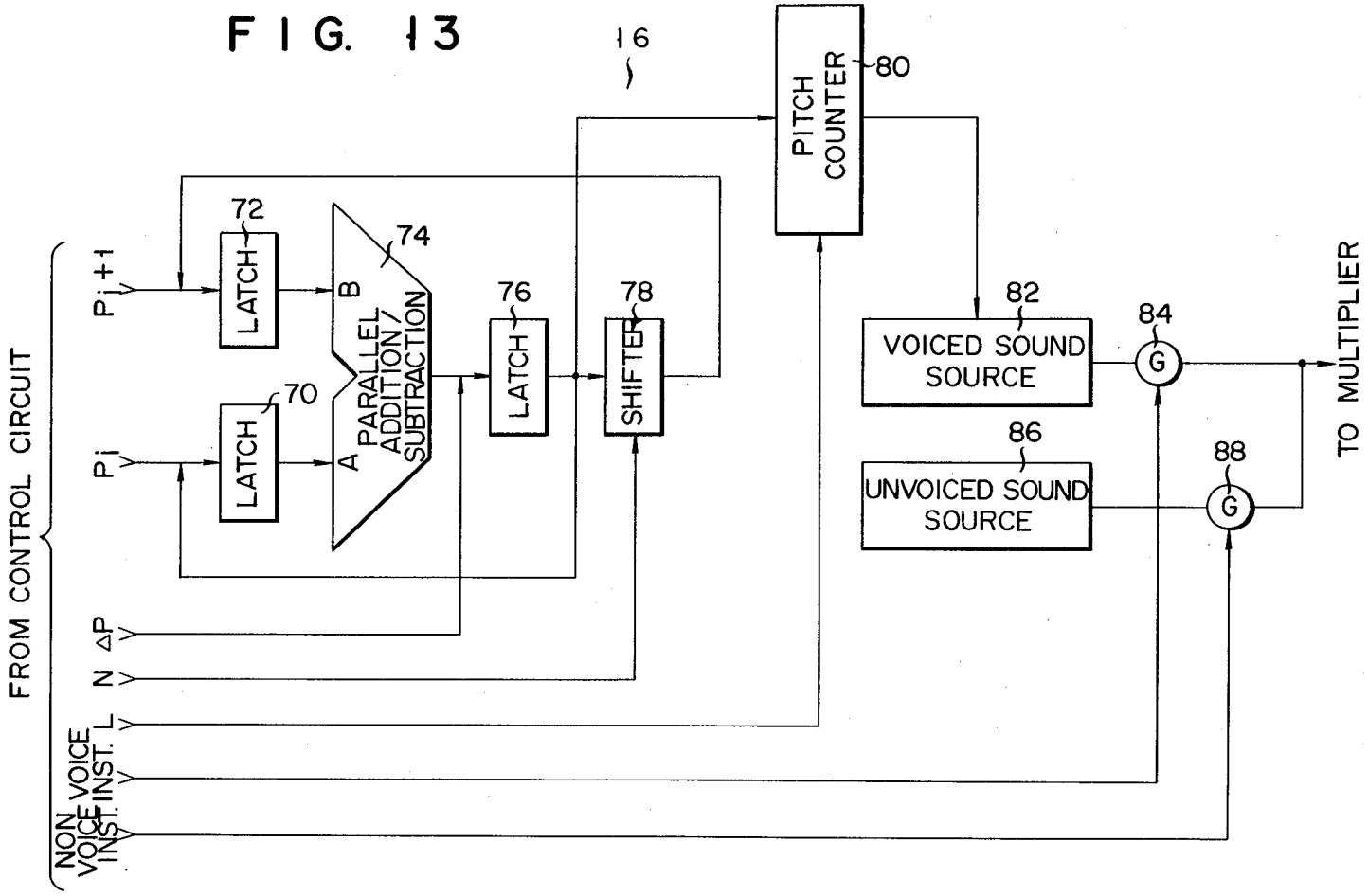
FIG. 13 is a detailed block diagram of an excitation circuit in FIG. 6A.

The excitation circuit 16 in FIG. 4 will be described in detail with reference to FIG. 13. Pitch period data $P_i$ from the control circuit 14 is supplied to a latch circuit 70, while pitch period data $P_{i+1}$ is supplied to a latch circuit 72. Data retained in the latch circuits 70 and 72 are respectively supplied to input terminals A and B of a parallel addition/subtraction circuit 74. An addition/subtraction output from the addition/subtraction circuit 74 is supplied to a latch circuit 76. The latch circuit 76 also receives differential data $\Delta P$ of the pitch period. The output from the latch circuit 76 returns to the latch circuit 70, and to the latch circuit 72 through a shifter 78. The shifter 78 also receives a frame length control signal N specified by a 2-bit synchronizing signal (FIG. 5A) from the control circuit 14. The shifter 78 shifts input data to the lower position by 1 bit or 2 bits in response to the frame length control signal N. In other words, the input data is $\frac{1}{2}$ or $\frac{1}{4}$ shifted and returns to the latch circuit 72. The output from the latch circuit 76 is also loaded into a pitch counter 80 in accordance with a load command L. Voiced sound source information (e.g., impulse) is read out from a voiced sound source circuit 82 in response to a pitch period count by the pitch counter 80 and is supplied to the multiplier 26 of the LSP speech synthesizer filter 18 through a gate circuit 84. The gate circuit 84 is controlled by the voiced sound command from the control circuit 14. Unvoiced sound source information (e.g., M sequence noise) from an unvoiced sound source circuit 86 is supplied to the multiplier 26 through a gate circuit 88. The gate circuit 88 is controlled by an unvoiced sound command from the control circuit 14.

Figure 14:
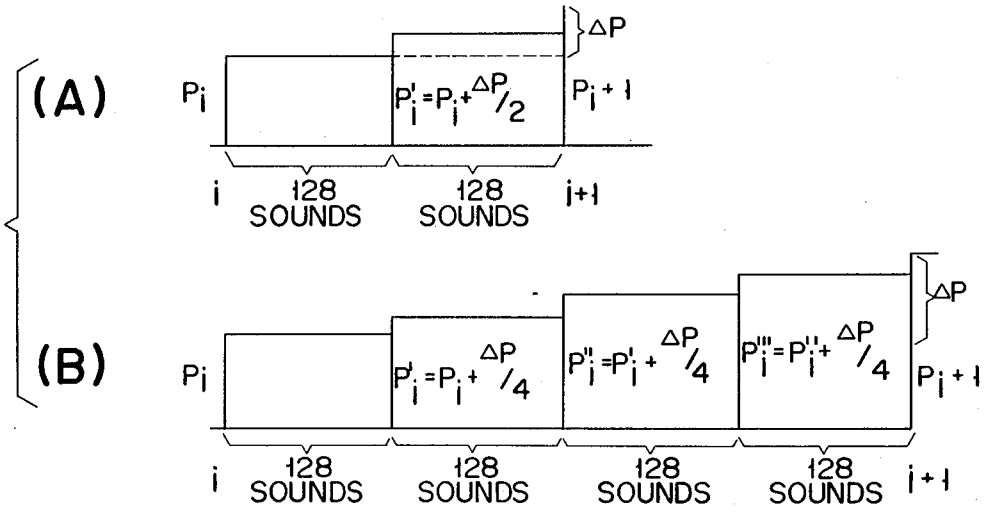
FIGS. 14A and 14B are views for explaining interpolation of the excitation circuit in FIG. 13.

With the above arrangement, at the initial setting, a pitch initial value $P_i$ from the control circuit 14 is retained in the latch circuit 70. At this time, the contents of the latch circuit 72 are all set to level "0". Therefore, the data $P_i$ of the latch 70 is directly produced by the addition/subtraction circuit 74 and is retained in the latch circuit 76. The data $P_i$ retained in the latch circuit 76 is loaded into the pitch counter 80 in accordance with the load command L. Voiced sound source information is read out from the voiced sound source circuit 82 in accordance with the contents of the pitch counter 80. At this time, if the voiced sound command is supplied to the gate circuit 84, the voiced sound source information is supplied to the multiplier 26 through the gate circuit 84. Pitch period data $P_{i+1}$ for the following frame after the initial value $P_i$ is supplied from the control circuit 14 to the latch circuit 72. Data $P_i$ retained in the latch circuit 70 in the addition/subtraction circuit 74 is subtracted from the pitch period data $P_{i+1}$ latched in the latch circuit 72 to obtain differential data ΔP. This differential data ΔP is retained in the latch circuit 76 and is then supplied to the shifter 78 to shift ½ or ¼ the differential data in accordance with a frame length control signal N. The shifted differential data is then retained in the latch circuit 72. In this case, the differential data ΔP supplied to the shifter 78 is ½ shifted if the (i)th frame has 256 sounds, while it is ¼ shifted if the (i)th frame has 512 sounds. While the latch circuit 72 retains data ΔP/2 or ΔP/4, excitation (sound source) information is read out. When data of 128 sounds is completely output, the data $P_i$ retained in the latch circuit 70 is added to the data ΔP/2 or ΔP/4 retained in the latch circuit 72 in the addition/subtraction circuit 74. As a result, data $P_i+(\Delta P/2)$ or $P_i+(\Delta P/4)$ is retained in the latch circuit 76. The addition data retained in the latch circuit 76 is then supplied to the latch circuit 70 and is also loaded into the pitch counter 80 in accordance with the load command L. Thereafter, voiced sound source information is read out from the voiced sound source circuit 82 in accordance with the content of the pitch counter 80. In the same manner as described above, pitch interpolation is subsequently performed. If the (i)th frame has 256 sounds, the data ΔP/2 is added to the data $P_i$ every 128 sounds, as shown in FIG. 14A. However, if the (i)th frame has 512 sounds, the data ΔP/4 is added to the data $P_i$ every 128 sounds, as shown in FIG. 14B, to perform pitch interpolation.

The above case is an example wherein the pitch period data $P_{i+1}$ follows the pitch initial value $P_i$. However, if the differential data ΔP follows the pitch initial value $P_i$, the differential data ΔP is retained in the latch circuit 76 and is then ½ or ¼ shifted in the shifter 78. Thereafter, the ΔP/2 or ΔP/4 data is supplied to the latch circuit 72, and the operation is the same as that described above. In other words, when the differential data ΔP is supplied from the control circuit 14 to the latch circuit 76, the operation is the same as that described above except that the subtraction "$P_i - P_{i+1} = \Delta P$" is omitted.

In the pitch interpolation operation above, if a pitch difference is outside a range of ±3 when (1) an unvoiced sound frame is changed to a voiced sound frame, (2) the voiced sound frame is changed to an unvoiced sound frame, or (3) the voiced sound frame is changed to another voiced sound frame, the control circuit 14 produces pitch period data $P_i$, $P_{i+1}$, or the like. However, if the pitch difference is within the range of ±3, that is, if differential data is within a range of "101" to "011" when the voiced sound frame is changed to another voiced frame, the control circuit 14 generates the differential data ΔP as pitch information. The voiced sounds are distinguished from the unvoiced sounds by 7-bit pitch period data. If the 7-bit data is all level "0", it determines a sound as the unvoiced sound. Otherwise, any sound is defined as the voiced sound. When the differential data is used, a logic value of "100" indicates the unvoiced sound. Otherwise, any sound is defined as the voiced sound.

In the excitation circuit 16, the pitch period interpolation of the voiced sounds is performed. The interpolation is very effective for the speech synthesizer device since the frame length is variable, resulting in excellent speech synthesis with a small number of data.

Figure 15A:
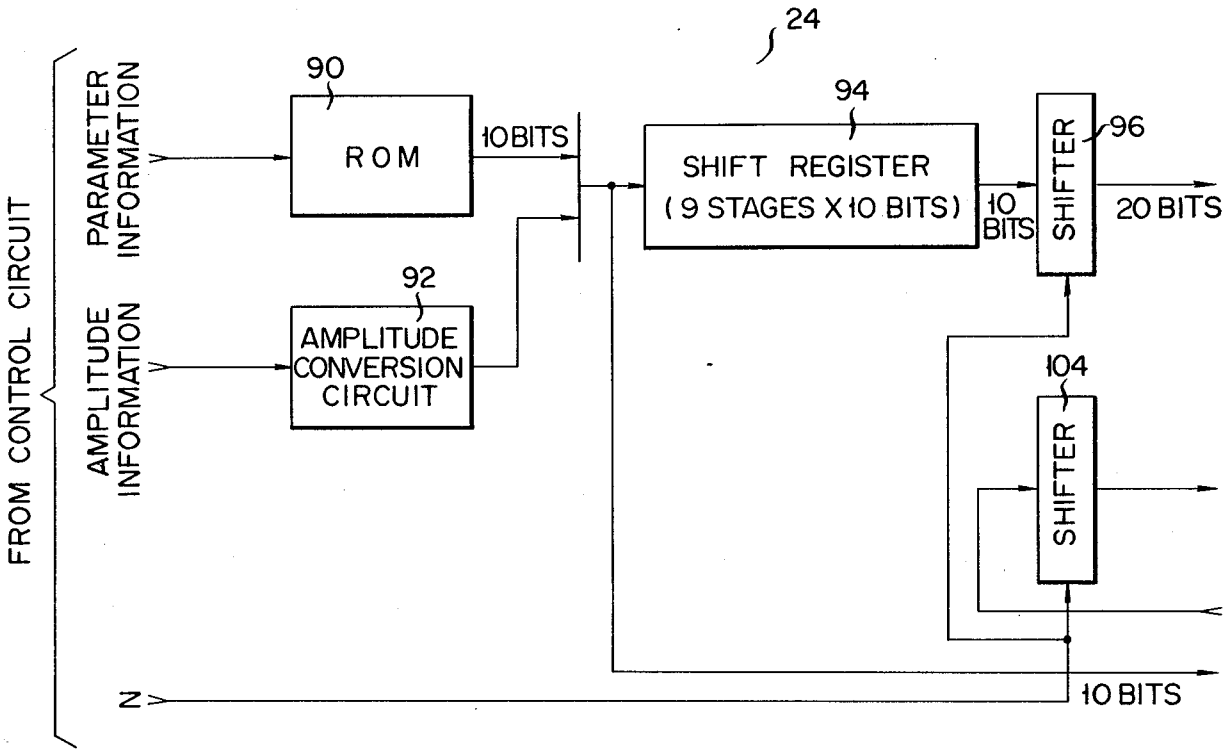
FIGS. 15A and 15B are detailed block diagrams of a parameter conversion circuit in FIG. 6A.
Figure 15B:
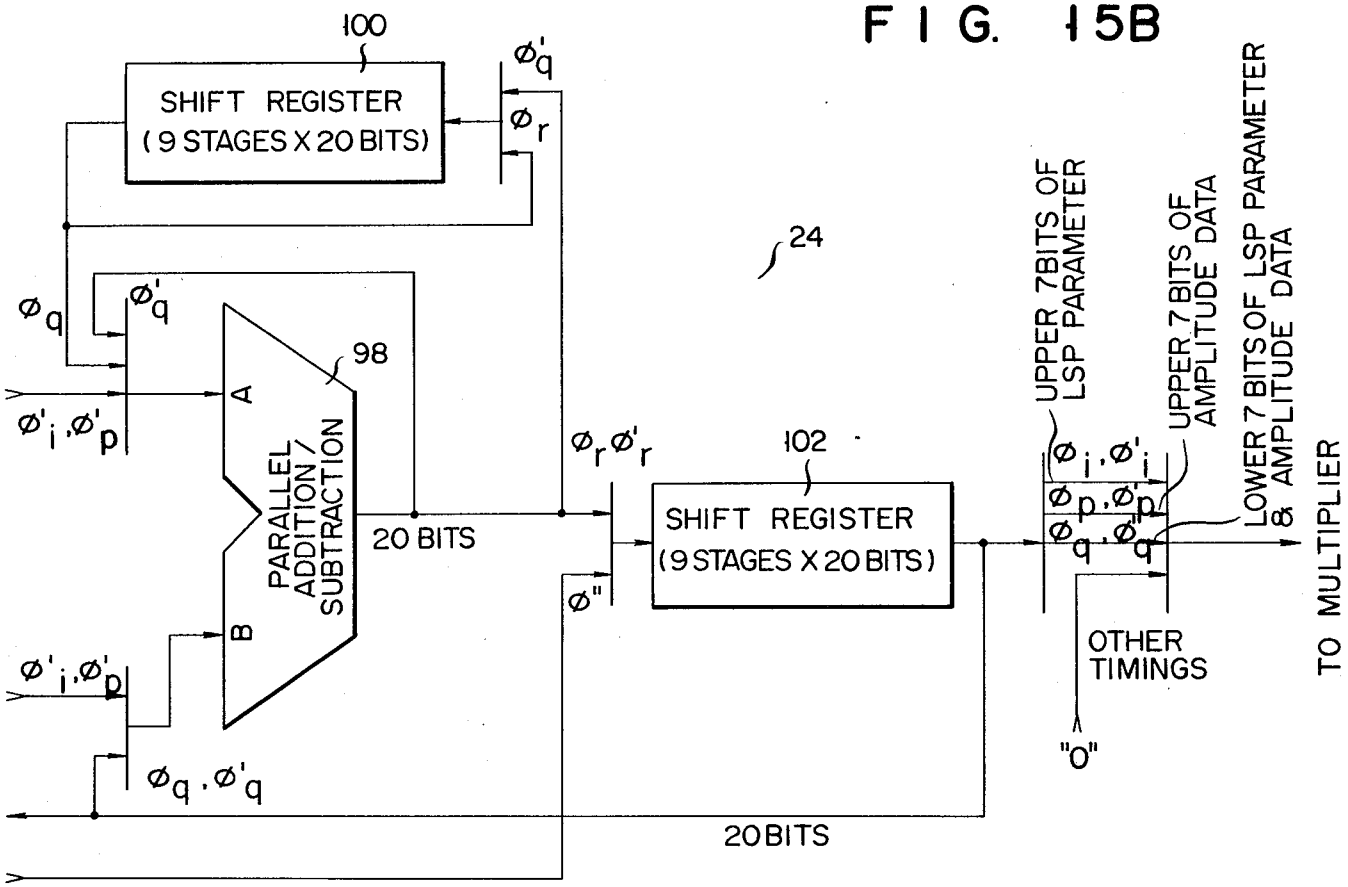

The parameter conversion circuit 24 in FIG. 6A will be described in detail with reference to FIGS. 15A and 15B. An ROM 90 for parameter conversion nonlinearly converts, to 10-bit "$-2\cos\omega_i$" data, the 4-bit LSP parameters $\omega_1$ to $\omega_8$ supplied from the ROM 12 (FIG. 4) through the control circuit 14 prior to a frame change. An amplitude conversion circuit 92 converts, to 10-bit amplitude data, the 6-bit amplitude information supplied by the ROM 12 through the control circuit 14 prior to a frame change on the basis of the function "$(0.5+A)\times 2^{-B}$" where A and B are 3-bit mantissa data and 3-bit exponent data, respectively. Six-bit data is thus supplied as the amplitude information to the amplitude conversion circuit 92. For example, the upper 3 bits define a mantissa, while the lower 3 bits define an exponent. As a whole, amplitude information "110010" is supplied to the amplitude conversion circuit 92. In the amplitude conversion circuit 92, 2-bit data of "01" is added to the MSB of the mantissa data, and the resulting MSB is defined as a decimal point to perform the operation "0.5+A". Thereafter, the data is shifted to the right by B bits. If, for example, the amplitude information "110010" is given, the mantissa A is calculated as "0.1110" by the operation "0.5+A". Further, when data "0.1110" is shifted to the right by B (010=2) bits, amplitude data "0.001110" is obtained. The amplitude data varies between 0 and 1. Data converted in the ROM 90 and the amplitude conversion circuit 92 are supplied to a shift register 94 in a predetermined order. The shift register 94 comprises 90 bits (=9 stages×10 bits), and an output therefrom is supplied to a shifter 96. The shifter 96 performs the shift operation in accordance with the frame length control signal N supplied by the control circuit 14 and produces 20-bit data. The frame length control signal N indicates a 7-bit shift command signal when the frame consists of 128 sounds, an 8-bit shift command signal when the frame consists of 256 sounds, and a 9-bit shift signal when the frame consists of 512 sounds, respectively. An output from the shifter 96 is supplied to an input terminal A of a parallel addition/subtraction circuit 98 in synchronism with timing signals $\phi i'$ and $\phi p'$. An output from the addition/subtraction circuit 98 is supplied to the input terminal A thereof in synchronism with a timing signal $\phi q'$, and also to a shift register 100. The shift register 100 comprises 180 bits (=9 stages×20 bits) and an output therefrom returns to the input terminal thereof in synchronism with a timing signal $\phi r$, and is also supplied to the input terminal A of the addition/subtraction circuit 98 in synchronism with a timing signal $\phi q$. An output from the addition/subtraction circuit 98 is supplied to a shift register 102 in synchronism with the timing signals $\phi r$ and $\phi r'$. The shift register 102 comprises 180 bits (=9 stages×20 bits) and an output therefrom is supplied to a shifter 104, and also to an input terminal B of the addition/subtraction circuit 98 in synchronism with the timing signals $\phi q$ and $\phi q'$. The shifter 104 performs the shift operation in the same manner as the shifter 96 in accordance with the frame length control signal N, and an output therefrom is supplied to the input terminal B of the addition/subtraction circuit 98 in synchronism with the timing signals $\phi i'$ and $\phi p'$. In the output from the shift register 102, the upper 7-bit data of the LSP parameter is supplied to the input terminal A of the multiplier 26 in FIG. 6A in synchronism with the timing signals $\phi i$ and $\phi i'$; the upper 7-bit data of the amplitude data is also supplied thereto in synchronism with the timing signals $\phi p$ and $\phi p'$; and the lower 7-bit data of the LSP parameter and the lower 7-bit data of the amplitude data are supplied thereto in synchronism with the timing signals $\phi q$ and $\phi q'$. The input terminal A of the multiplier 26 receives a signal of level "0" at any timing except those timings synchronous with the timing signals $\phi i$, $\phi i'$, $\phi p$, $\phi p'$, $\phi q$ and $\phi q'$. The timing signals $\phi p$, $\phi q$, $\phi r$ and $\phi i$ used in the parameter conversion circuit 24 are respectively generated at the timings shown in FIGS. 16A and 16B. The timing signals $\phi p'$, $\phi q'$, $\phi r'$ and $\phi i$ are generated between time T22 of one speech interval and time T21 of the next speech interval. Further, a timing signal $\phi''$ is generated at the initial period and at the period when an unvoiced interval is changed to the next voiced interval.

In the parameter conversion circuit 24 with the above arrangement, the ROM 90 performs LSP parameter conversion of "$-2 \cos \omega$" for the first frame, while the amplitude conversion circuit 92 performs amplitude conversion of "$(0.5+A)\times 2^{-B}$". These conversion data are supplied to the shift register 102 in synchronism with the timing signal $\phi''$ and are retained therein. The parameter conversion and amplitude conversion for the second frame are performed in the ROM 90 and the amplitude conversion circuit 92, respectively. These converted data are then written in the shift register 94. The data for the second frame which are written in the shift register 94 and the data for the first frame which are written in the shift register 102 are supplied respectively to the shifters 96 and 104 in accordance with the frame length control signal N. Data shifted in the shifters 96 and 104 are supplied respectively to the input terminals A and B of the addition/subtraction circuits 98 in synchronism with the timing signals $\phi i'$ and $\phi p'$. The input data at the input terminal B is subtracted from the input data at the input terminal A to obtain differential data for the LSP parameter and the amplitude data. Differential data $\Delta C_i/n$ of the LSP parameter and differential data $\Delta A/n$ of the amplitude data respectively divided by n (where n indicates one of 128, 256 or 512 sounds and corresponds to the number of speech sounds for the frame) are obtained and are supplied to the shift register 100 in synchronism with the timing signal $\phi q'$. The differential data $\Delta C_i/n$ and $\Delta A/n$ produced by the addition/subtraction circuit 98 return to the input terminal thereof and are added to data for the first frame which is output by the shift register 102. The addition result is again written in the shift register 102 and the content thereof is supplied to the multiplier 26. While the parameter and the amplitude value are interpolated, the content of the shift register 102, that is, the first frame value, is supplied to the multiplier 26 in synchronism with the timing signals $\phi i'$, $\phi p'$ and $\phi q'$. The differential data written in the shift register 100 are supplied to the addition/subtraction circuit 98 in synchronism with the timing signal $\phi q$ and are added to the output from the shift register 102. The addition result is then supplied to the shift register 102. By addition as described above, the LSP parameter data and amplitude data can be interpolated. The interpolation is performed every speech interval. In the same manner as described above, new differential data is obtained each time the speech sound frame is changed and is added to the LSP parameter data and the amplitude data to repeat interpolation.

In the speech synthesizer device according to this embodiment of the present invention, linear interpolation of a parameter and an amplitude value is performed every sampling period. Therefore, highly precise speech synthesis can be performed with a small amount of data.

Such interpolation can be performed with hardware described above. However, the control circuit 14 having an ROM, an RAM and an ALU may be used to perform interpolation in a software manner.

In the above embodiment, one speech interval is defined as a 23T cycle which corresponds to a time interval from time T1 to time T23. However, a shorter cycle may also be used. In a system to be described below, 20T (time T1 to time T20) is defined as one cycle for a speech interval. Therefore, if the bandwidth of a synthesis speech signal is defined as 4 kHz, its master clock pulse frequency is 160 kHz (8 kHz$\times$20).

The master clock pulses used for this system are substantially the same as those shown in FIGS. 9A to 9C, thus a detailed description thereof will be omitted.

Figure 17A:
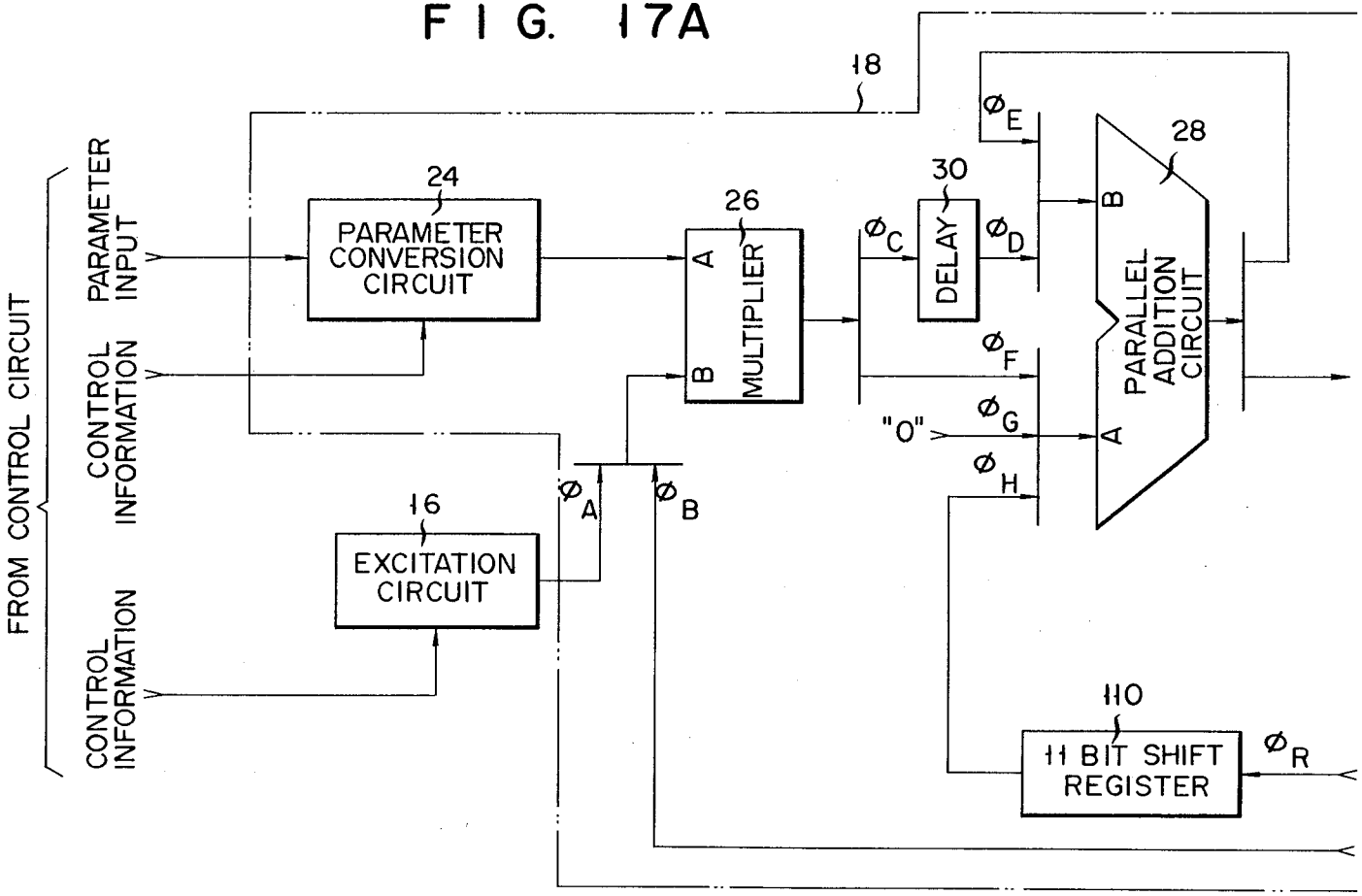
FIGS. 17A and 17B are block diagrams of an LSP speech synthesizer digital filter according to one embodiment of the present invention.
Figure 17B:
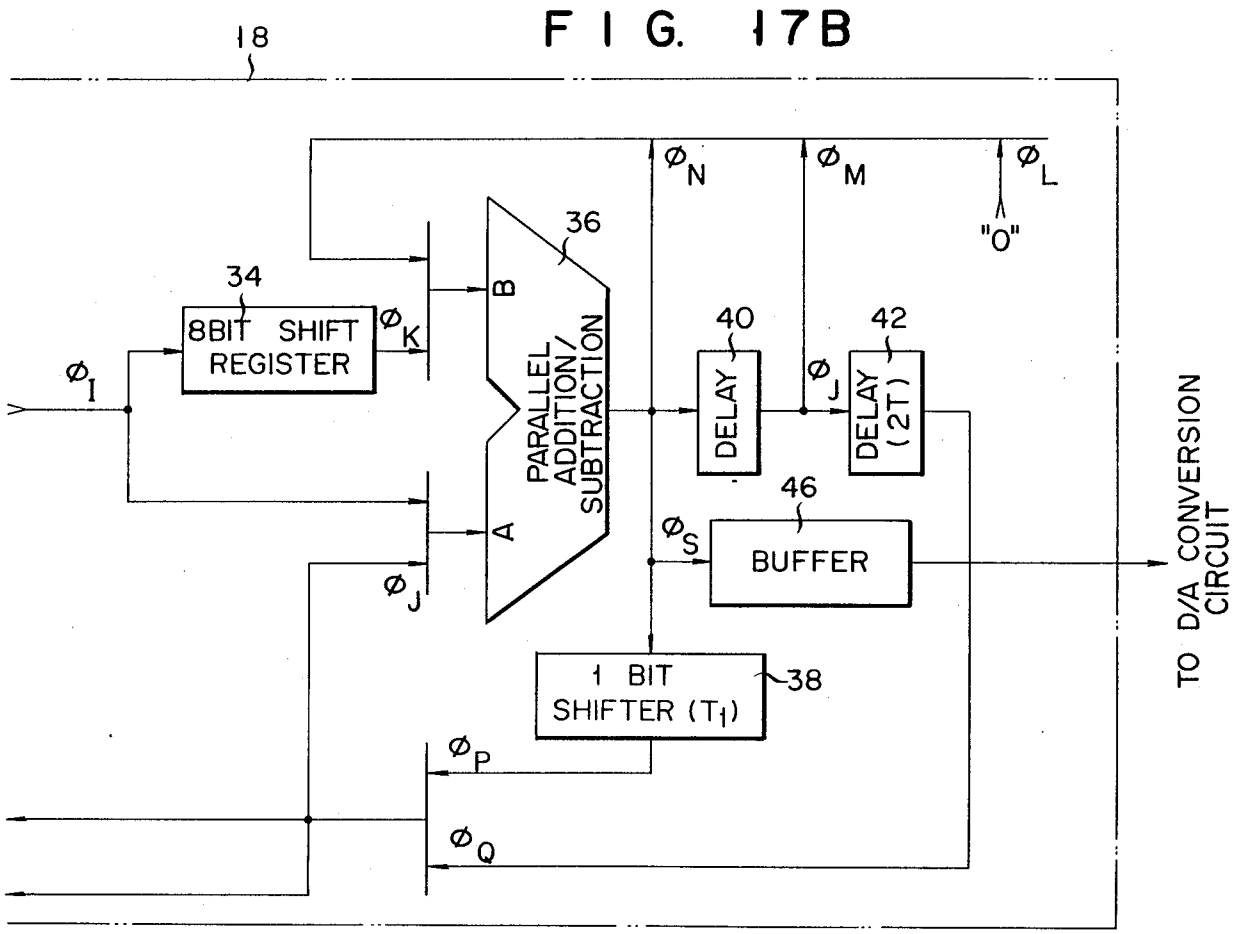

FIGS. 17A and 17B show an example where one speech interval is a duration from time T1 to time T20. The reference numerals used in FIGS. 6A and 6B (first embodiment) denote the same parts as in FIGS. 17A and 17B (second embodiment), and a detailed description thereof will be omitted. The device according to the second embodiment in FIGS. 17A and 17B comprises the same circuit elements as those in the first embodiment of FIGS. 6A and 6B except that an 11-bit shift register 110 is used in place of the 13-bit shift register 44. FIGS. 18A and 18B show input/output data of the multiplier 26, the parallel addition circuit 28, the parallel addition/subtraction circuit 36, the shift registers 34 and 110, and the buffer circuit 46 shown in FIGS. 17A and 17B, at time T1 to time T20. Timing signals $\phi A$ to $\phi S$ used in the second embodiment in FIGS. 17A and 17B are generated at timings shown in FIGS. 19A and 19B, respectively. In the second embodiment of FIGS. 17A and 17B, an operation corresponding to the algorithm shown in FIGS. 3A to 3C is performed in the same manner as in the first embodiment of FIGS. 6A and 6B. Referring to FIG. 18B, input data with a triangular mark indicates input data to the 8-bit shift register 34, while unmarked input data indicates input data to the 11-bit shift register 110.

In the second embodiment, processing time (5T) from time T17 to time T21 in FIGS. 8A and 8B is substituted by processing time (2T) from time T17 to time T18. For this reason, the shift register 110 has an 11-bit capacity. Further, the delay circuit 42 allows writing in response to the clock pulse $\phi 1$ synchronous with the timing signal $\phi J$, and readout in response to the clock pulse $\phi 2$. The 1-bit shifter 38 retains data e1(n) (=e2(n)) which is shifted in response to the clock pulse $\phi 2$ at time T1.

Since the speech interval is defined as 20T, the master clock pulse frequency is lowered. Further, the various timing signals can be easily generated as compared with the speech interval defined as 23T.

Figure 20A:
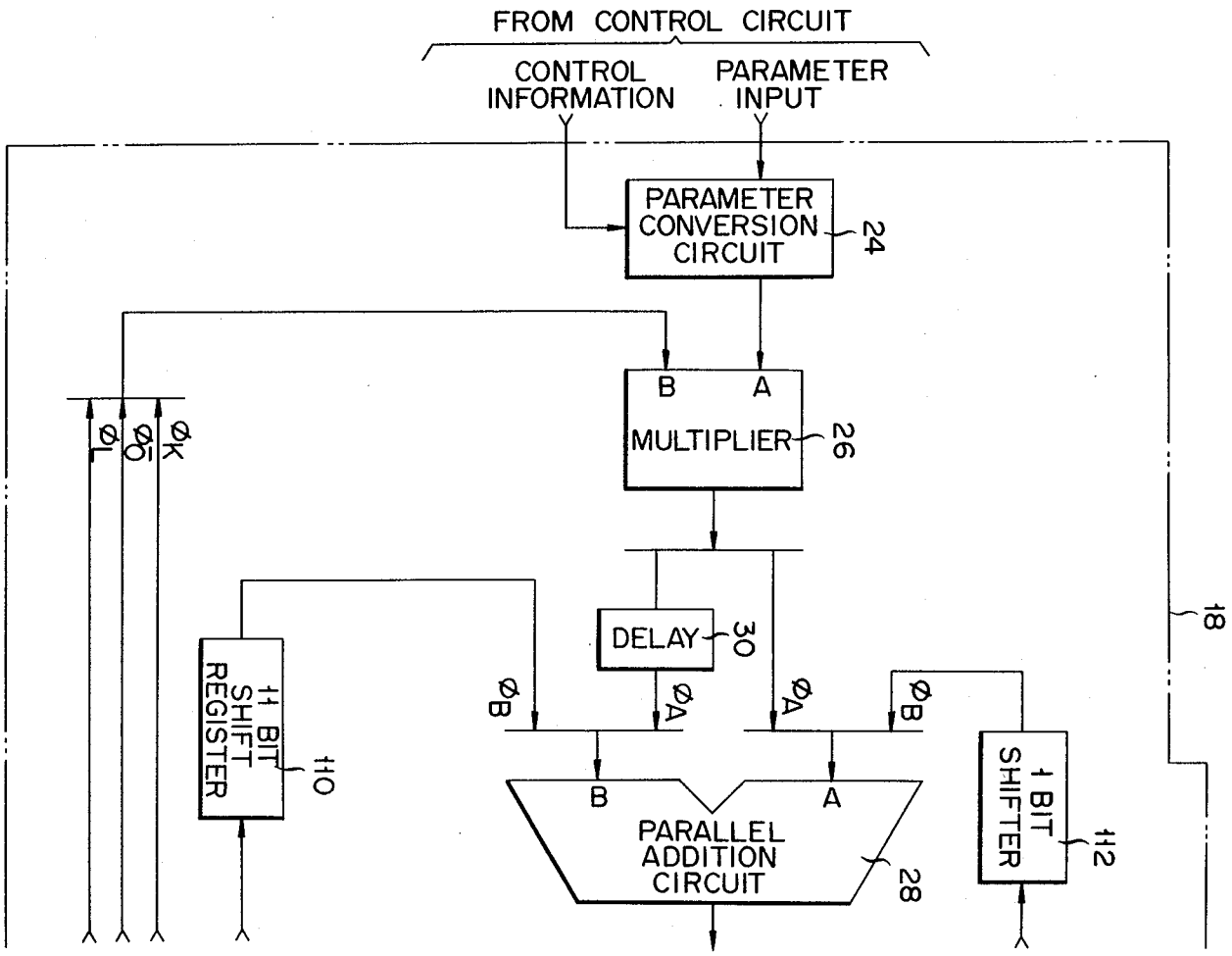
FIGS. 20A and 20B are block diagrams of an LSP speech synthesizer digital filter according to another embodiment of the present invention.
Figure 20B:
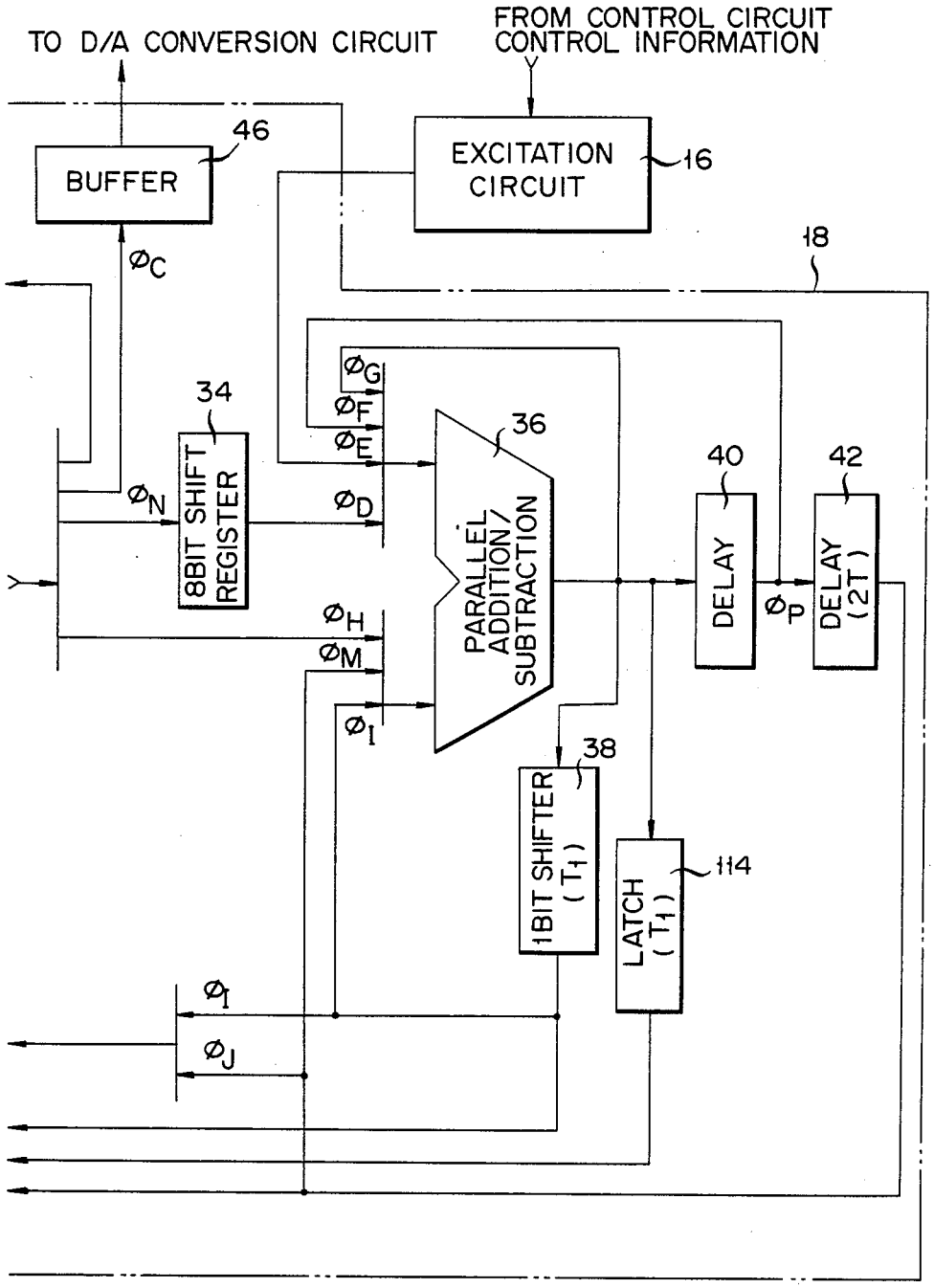

FIGS. 20A and 20B show an LSP speech synthesizer according to a third embodiment of the present invention. In the third embodiment, data of synthesized sound is multiplied by amplitude information, while in the first and second embodiments, the sound source (excitation) information is multiplied by the amplitude information. The speech interval of the synthesizer according to the third embodiment is defined as a time interval from time T1 to time T20 in the same manner as in the second embodiment. The same reference numerals used in the second embodiment denote the same parts in the third embodiment, and a detailed description thereof will be omitted. In order to multiply the amplitude information with data of the synthesized sound, the output from the excitation circuit 16 is supplied to the input terminal B of the addition/subtraction circuit 36 in synchronism with the timing signal $\phi$E. Further, the output from the addition circuit 28 returns to the input terminal A thereof through a 1-bit shifter 112 in synchronism with the timing signal $\phi$B. The shifter 112 shifts input data to a higher position by 1 bit. In other words, the shifter 112 doubles the input data. The parameter conversion circuit 24 performs parameter conversion of "$C_i' = -\cos \omega_i$". Thereafter, the shifter 112 doubles conversion data. A latch circuit 114 is arranged which temporarily stores the output from the addition/subtraction circuit 36, and which supplies data to the input terminal B of the multiplier 26 in synchronism with the timing signal $\phi$O. A final speech synthesis output among the output data from the addition circuit 28 is supplied to the buffer 46 in synchronism with the timing signal $\phi$C. The retained data is then supplied to the D/A converter 20. In the third embodiment of FIGS. 20A and 20B, the operation corresponding to the algorithm in FIGS. 3A to 3C is performed in the same manner as in the first and second embodiments, provided that O1(n) is V(n)−e1′(n), where V(n) is the excitation information in FIG. 3C. FIGS. 21A and 21B show input/output data of the multiplier 26, the parallel addition circuit 28, the parallel addition/subtraction circuit 36, the shift registers 34 and 110, and the buffer 46, at time T1 to time T20. FIGS. 22A and 22B show timings of the timing signals $\phi$A to $\phi$P used in the third embodiment. Note that U(n) in FIGS. 21A and 21B corresponds to A·O010(n).

According to the third embodiment, amplitude information interpolation follows filter operation. Since the excitation information, that is, an impulse or noise, has a predetermined amplitude, the dynamic range of the signal in the filter can be narrowed, and the number of bits of the bus lines may be decreased. Therefore, the LSP speech synthesizer according to the third embodiment is suitable for LSI.

What we claim is:

1. An LSP voice synthesizer, comprising:

a memory for storing various voice parameters necessary to LSP voice synthesis;

controlling means, coupled to said memory, for reading out a predetermined voice parameter in accordance with external input data;

excitation means, coupled to said controlling means, for producing excitation information in accordance with the predetermined voice parameter received from said controlling means;

LSP voice synthesizing means, coupled to said controlling means and to said excitation means and comprising a plurality of parallel operating circuits, each of which includes a parallel multiplier circuit for dividing input data into upper bits and lower bits, and for multiplying the upper and the lower bits separately at specified different timings to obtain a partial product of the upper bits and a partial product of the lower bits, delay circuits and shift registers, for performing LSP voice synthesis by parallel processing of the predetermined voice parameter received from said controlling means and the excitation information received from said excitation means;

D/A converting means, coupled to said LSP voice synthesizing means, for converting a digital output from said LSP voice synthesizing means to an analog signal; and timing signal generating means, coupled to said controlling means and to said LSP voice synthesizing means for generating a predetermined timing signal to each one of said controlling means, said LSP voice synthesizing means, and said excitation means, on the basis of an externally supplied clock pulse.

2. A synthesizer according to claim 1, wherein said LSP voice synthesizing means comprises: a parallel addition circuit, one input terminal of which is directly connected to an output of one said parallel multiplier circuit and the other input terminal of which is connected thereto through a delay circuit, said parallel addition circuit synthesizing the partial products of the upper and lower bits at a predetermined timing and adding other input data at another predetermined timing; a parallel addition/subtraction circuit, connected to said parallel addition circuit, for adding input data at a predetermined timing and for subtracting input data at another predetermined timing; a first shifter circuit, connected to said parallel addition circuit, for shifting an output from said parallel addition circuit by a predetermined number of bits and for supplying an output to said parallel addition/subtraction circuit; a second shifter circuit, connected to said parallel addition/subtraction circuit, for shifting an output from said parallel addition/subtraction circuit only at a predetermined timing by a second predetermined number of bits; a third shifter circuit, connected to said second shifter circuit, for shifting an output from said second shifter circuit by a third predetermined number of bits and for supplying an output to said parallel addition circuit; a delay circuit for delaying the output from said addition/subtraction circuit by a predetermined time interval and for supplying an output to said parallel multiplier circuit; and a buffer circuit connected to a predetermined output terminal of each of said parallel multiplier circuits, said parallel addition circuit, said parallel addition/subtraction circuit, said first shifter circuit, said second shifter circuit, said third shifter circuit, and said delay circuit, said buffer circuit temporarily storing an output from each of said predetermined output terminals; wherein said circuits perform a parallel operation corresponding to an algorithm for LSP voice synthesis.

3. A synthesizer according to claim 2, wherein said parallel multiplier circuit comprises: a division circuit for dividing input data into a plurality of data; first and second multiplier circuits, respectively connected to said division circuit, for multiplying input data from said division circuit with predetermined input data in accordance with a Booth algorithm; a first parallel addition circuit, connected to said first and second multiplier circuits, for adding outputs in parallel from said first and second multiplier circuits; a third multiplying circuit, connected to said division circuit through a delay circuit, for multiplying data delayed by said division circuit with the predetermined input data delayed by another delay circuit in accordance with the Booth algorithm; a second parallel addition circuit, connected to said third multiplier circuit and said first parallel addition circuit through still another delay circuit, for parallel adding outputs therefrom; and a delay circuit, connected to said second parallel addition circuit, for delaying the input data by a predetermined time interval.

4. A synthesizer according to claim 1, wherein said LSP voice synthesizing means performs operations at various timings on the basis of a sampling period 20T wherein T is a master processing time interval.

5. A synthesizer according to claim 1, wherein said LSP voice synthesizing means performs operations at various timings on the basis of a sampling period 23T wherein T is a master processing time interval.

* * * * *